US005347763A

United States Patent [19]

Miyamato et al.

[11] Patent Number: 5,347,763

[45] Date of Patent: Sep. 20, 1994

[54] POLISHING APPARATUS

[75] Inventors: Masahiko Miyamato, Tokyo; Nobuo Nakamura, Yokohama; Jyunji Takashita, Yokohama; Manabu Ando, Yokohama; Katsuo Kawano, Kawasaki; Yoshiaki Nishimura; Satoshi Yuasa, both of Yokohama, all of Japan

[73] Assignee: Canon Kabushiki Kaisha, Tokyo, Japan

[21] Appl. No.: 157,440

[22] Filed: Nov. 26, 1993

Related U.S. Application Data

[60] Continuation of Ser. No. 942,335, Sep. 9, 1992, abandoned, which is a continuation of Ser. No. 637,827, Jan. 7, 1991, abandoned, which is a division of Ser. No. 569,386, Aug. 15, 1990, Pat. No. 4,999,954, which is a continuation of Ser. No. 414,268, Sep. 29, 1989, abandoned, which is a continuation of Ser. No. 169,060, Mar. 16, 1988, Pat. No. 4,974,368.

[30] Foreign Application Priority Data

| | | | |
|---|---|---|---|
| Mar. 19, 1987 | [JP] | Japan | 62-041157[U] |
| Mar. 19, 1987 | [JP] | Japan | 62-041158[U] |
| Mar. 19, 1987 | [JP] | Japan | 62-062587 |
| Mar. 19, 1987 | [JP] | Japan | 62-062601 |
| Mar. 19, 1987 | [JP] | Japan | 62-062610 |
| Mar. 19, 1987 | [JP] | Japan | 62-062612 |
| Mar. 19, 1987 | [JP] | Japan | 62-062613 |
| Mar. 19, 1987 | [JP] | Japan | 62-066715 |
| Mar. 19, 1987 | [JP] | Japan | 62-066717 |

[51] Int. Cl.[5] ..... B24B 49/00

[52] U.S. Cl. ..... 451/241; 451/36

[58] Field of Search ..... 51/7, 55, 56, 124 L, 51/126, 284 R, 165.71, 165.77, 317

[56] References Cited

U.S. PATENT DOCUMENTS

| | | | |
|---|---|---|---|
| 3,330,075 | 7/1967 | Suddarth et al. | 51/124 L |
| 3,564,776 | 2/1971 | Aspden | 51/55 |
| 3,566,544 | 3/1971 | Aspden | 51/55 |
| 3,587,195 | 6/1971 | Aspden | 51/284 |
| 3,589,078 | 6/1971 | Bala | 51/165 |
| 3,676,960 | 6/1972 | Aspden | 51/165 |
| 3,769,762 | 11/1973 | Mayo | 51/284 |
| 4,800,684 | 1/1989 | Effenberger | 51/241 VS |
| 4,956,944 | 9/1990 | Hiyoshi | 51/165 |

FOREIGN PATENT DOCUMENTS

| | | |
|---|---|---|
| 58-181561 | 10/1983 | Japan . |
| 59-001147 | 1/1984 | Japan . |
| 59-169763 | 9/1984 | Japan . |
| 60-039510 | 6/1985 | Japan . |

*Primary Examiner*—M. Rachuba

*Attorney, Agent, or Firm*—Fitzpatrick, Cella, Harper & Scinto

[57] ABSTRACT

There is disclosed a polishing apparatus utilizing a gel material as the polishing tool, in which the gel material is rotated in the vicinity of a surface to be polished, or is given rotating and rocking motions in direct contact with the surface to be polished.

3 Claims, 14 Drawing Sheets

POLISHING APPARATUS

This application is a continuation of application Ser. No. 07/942,335, filed Sep. 9, 1992, now abandoned, which is a continuation of application Ser. No. 07/637,827, filed Jan. 7, 1991, now abandoned, which is a division of application Ser. No. 07/569,386, filed Aug. 15, 1990, which issued as U.S. Pat. No. 4,999,954, on Mar. 19, 1991, which is a continuation of application Ser. No. 07/414,268, filed Sep. 29, 1989, now abandoned, which is a continuation of application Ser. No. 07/169,060, filed Mar. 16, 1988, which issued as U.S. Pat. No. 4,974,368, on Dec. 4, 1990.

BACKGROUND OF THE INVENTION

1. Field of the Invention

The present invention relates to a polishing apparatus for high precision polishing of a surface of an optical component such as lens or mirror or a metal mold, and more particularly to such polishing apparatus for polishing, by immersing a work piece in polishing liquid, to a surface precision in the order of an Angstrom.

2. Related Background Art

An apparatus for polishing a work piece such as an optical component or a metal mold by immersing said work piece in polishing liquid is already disclosed in the Japanese Patent Publication No. 39510/1985. Said apparatus is equipped with a liquid tank, formed surrounding a stage and holding liquid containing an abrasive material therein. In said liquid immersed is a flat disk which is mounted on a rotating shaft and is driven by a motor. In said apparatus the rotation of the motor generates a flow of the liquid between said rotary disk and a work piece fixed in said tank, whereby the abrasive material in said liquid collides with the surface of said work piece and abrades the surface of the work piece by a small amount. In the above-cited patent it is reported that the surface of stainless steel could be polished to a coarseness of 0.002 μm employing MgO of a particle size of 0.1 μm as the abrasive.

SUMMARY OF THE INVENTION

A first object of the present invention is to provide a polishing apparatus for immersing a work piece in polishing liquid and rotating a polishing tool thereby causing the abrasive material in the polishing liquid to collide with a surface of the workpiece to be polished and thus polishing said surface.

It is also an object of the present invention to provide a polishing apparatus capable of obtaining an improved precision of surface coarseness in the order of an Angstrom, in contrast to the conventional limit of polishing of 1/100–1/1000 μm, for meeting a requirement to improve the surface coarseness of an optical component of a metal mold, which has been in the order of 1 μm.

The foregoing objectives can be achieved according to the present invention by a polishing apparatus employing a gel substance and effectively utilizing the characteristics thereof.

It is also an object of the present invention to cover the process of producing the polishing tool utilizing the gel substance and to provide an apparatus capable of effectively supplying the surface to be polished with the abrasive material in the polishing liquid utilizing said gel substance.

A second object of the present invention is to provide an apparatus capable of correcting the polishing position of the polishing tool influencing the surface of the work piece. A specific object relates to the correction of the position when the working position of the polishing tool is shifted by the pressure, and another object is to provide an apparatus capable of preventing the shift of a predetermined working position, by controlling the pressure applied to the polishing tool.

A third object of the present invention is to provide an apparatus capable, in polishing a surface of a work piece with a polishing tool by supporting said work piece in a tank of polishing liquid, of classifying the size of the abrasive material, for example grindstone, in the polishing liquid into different layers in said liquid and selectively using such layers of abrasive according to the desired amount of abrasion of the surface of the work piece.

BRIEF DESCRIPTION OF THE DRAWINGS

FIGS. 1 to 8 relate to the first object of the present invention wherein:

FIG. 1 is a schematic lateral view of an embodiment of the polishing method of the present invention FIG. 2 is a chart showing the following speed in the present invention;

FIG. 4 is a magnified cross-sectional view of a polishing tool of the present invention;

FIG. 5 is a schematic perspective view of an embodiment of the polishing apparatus of the present invention;

FIG. 6 is a schematic lateral view showing a conventional polishing method;

FIG. 7 is a chart showing the following speed of abrasive in the conventional polishing method;

FIG. 8 is a cross-sectional view showing a second embodiment for meeting the first object of the present invention;

FIGS. 11 to 18 relate to the second object of the present invention, wherein:

FIG. 11 is a lateral view showing the displacement sensor at the end of the polishing tool;

FIG. 12 is a schematic lateral view of an embodiment of the present invention;

FIG. 13 is a block diagram of a control circuit;

FIGS. 14 and 15 are schematic views showing the displacement of the polishing tool;

FIG. 16 is a block diagram of another embodiment of the present invention;

FIGS. 17 and 18 are schematic views showing other embodiments;

FIGS. 19 to 27 relate to a third object of the present invention; wherein:

FIGS. 19 to 23 illustrate a first embodiment in which:

FIG. 19 is a perspective view of a polishing apparatus for liquid polishing according to the present invention;

FIG. 20 is a cut-open partial perspective view of a polishing tank equipped with an ultrasonic oscillator;

FIGS. 21 to 23 are schematic cross-sectional views of three different embodiments of a polishing particle layer forming apparatus;

FIGS. 24 to 27 illustrate a second embodiment, in which:

FIG. 24 is a schematic view of a polishing apparatus embodying the present invention;

FIG. 25 is a schematic cross-sectional view of a polishing tank in the polishing operation;

FIG. 26 is a flow chart showing the control sequence of the polishing operation; and FIG. 27 is a schematic view showing the trajectory of movement of the polishing position on the surface to be polished.

DETAILED DESCRIPTION OF THE PREFERRED EMBODIMENTS

(1) Embodiment Utilizing Gel Substance (1-1) In the present embodiment, a work piece to be polished and a polishing tool having a macromolecular gel substance on the surface of the tool are positioned in polishing liquid, and the polishing operation is achieved by a relative motion of said polishing tool with respect to the work piece thereby causing the polishing liquid to collide with the surface of said work piece.

Also there is provided a polishing tool, to be employed in the above-explained method, featured by having a macromolecular gel substance on the surface of the tool.

The polishing method and the polishing tool of the present embodiment will now be explained in detail by the attached drawings.

The polishing liquid is of an aqueous base.

Figure 1:
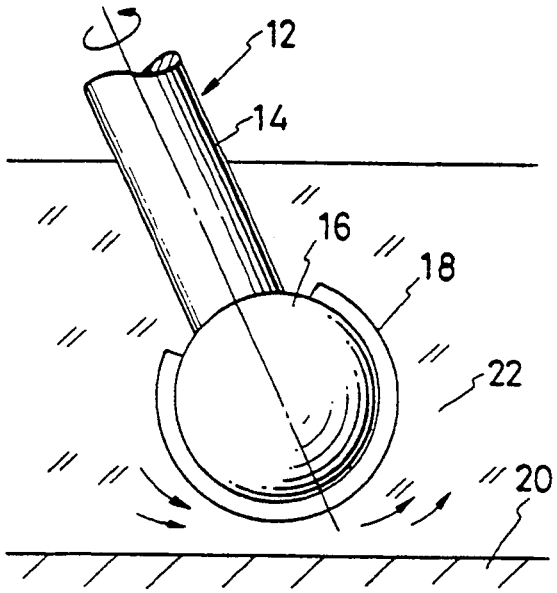

FIG. 1 is a schematic lateral view showing an embodiment of the polishing method of the present invention.

In FIG. 1, a polishing tool 12 has a cylindrical rotary shaft 14 to which attached, at an end, is a porous aluminum sphere 16. Around said sphere 16 attached is hydrophilic polymer gel 18 (for example polyvinyl pyrrolidone). Said polymer gel is preferably hydrophilic since the polishing liquid is water-based.

A work piece 20 to be polished is placed, together with the aluminum sphere 16 of the polishing tool 12 and said hydrophilic polymer gel 18, in polishing liquid 22 containing abrasive particles therein.

The sphere 16 bearing the polymer gel 18 is rotated in said polishing liquid 22 to drive the liquid 22 therearound, thereby giving a required flow rate to said polishing liquid 22. The polymer gel 18 is moved closer to a portion to be polished of the work piece 20, thereby generating a dynamic pressure of the polishing liquid 22 between the polymer gel 18 and the work piece 20, and thus achieving the polishing operation.

Consequently the polishing method of the present embodiment is same, in basic principle, as the conventional method, except that the polishing tool is provided, at the end thereof, with hydrophilic polymer gel.

In the following there will be explained the effect of use of a polishing tool having hydrophilic polymer gel in the above-explained polishing method.

Figure 2:
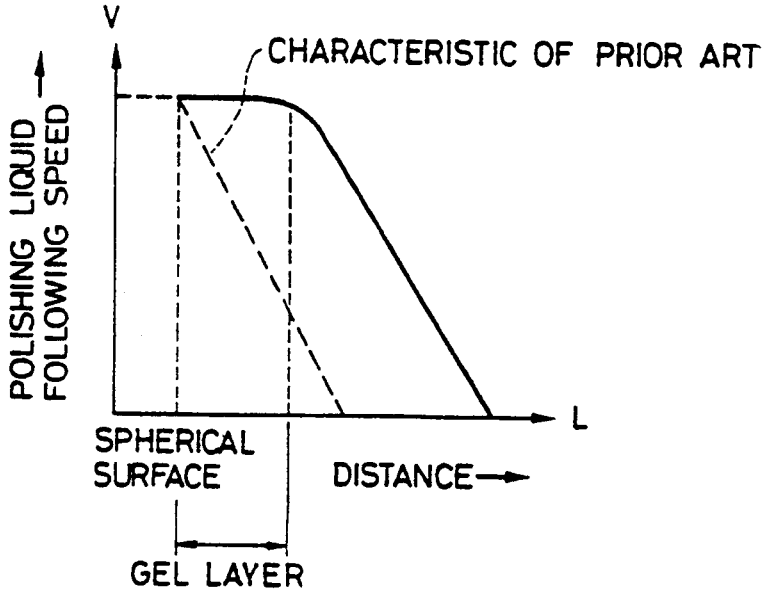

FIG. 2 is a chart showing the following speed of the polishing liquid 22 around the polishing tool 12, when it is rotated in said liquid.

As shown in FIG. 2, the hydrophilic polymer gel layer drives the polishing liquid therearound, so that the following speed of the liquid behaves as if it is shifted from the aluminum sphere corresponding to the thickness of the gel layer, as the gel layer need not be considered as the central sphere (In fact the gel layer cannot be microscopically considered as solid because the crosslinking is space).

It is therefore rendered possible to conduct the polishing without sacrificing the efficiency even when the central sphere (aluminum sphere 16) is sufficiently spaced from the work piece. Also this will reduce the danger of eventual contact.

The use of an aluminum sphere at the end of the rotary shaft 14 as in the present embodiment allows to improve the precision of said sphere as will be explained later, and thus to improve the precision of rotation.

The hydrophilic polymer gel layer 18, formed on the periphery of the aluminum sphere 16, does not damage the work piece 20 in case of eventual contact therewith. It is therefore possible to utilize a portion of liquid of a higher flow speed (portion close to the sphere 16), and thus to improve the working efficiency.

If ultrafine particles of silica (particle size in the order of several tens of Angstrom) are used as the abrasive particles in the polishing liquid, said liquid penetrates into the gel layer 18, thereby making a more obscure boundary between the polishing liquid and the polishing sphere.

The effect of the polishing tool of the present invention has been explained in the foregoing.

In the following there will be explained an example of the method of preparing the polishing tool of the present invention, while making reference to FIGS. 3A–3D.

Figure 3A:
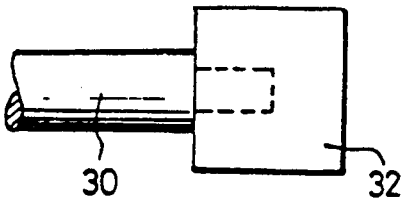
FIGS. 3A–3D is a view showing the method of producing the polishing tool of the present invention.
Figure 3B:
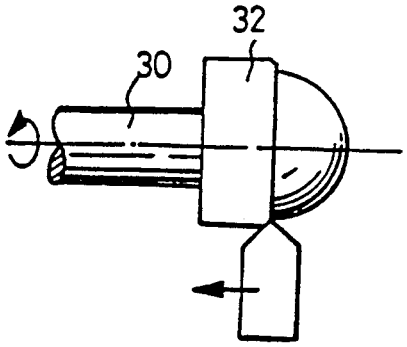

At first, as shown in FIG. 3A, a porous aluminum material 32 is fixed, for example with an epoxy adhesive, to an end of a tool shaft 30, and, as shown in FIG. 3B, said aluminum material 32 is formed as a sphere by a scraping operation.

Figure 3C:
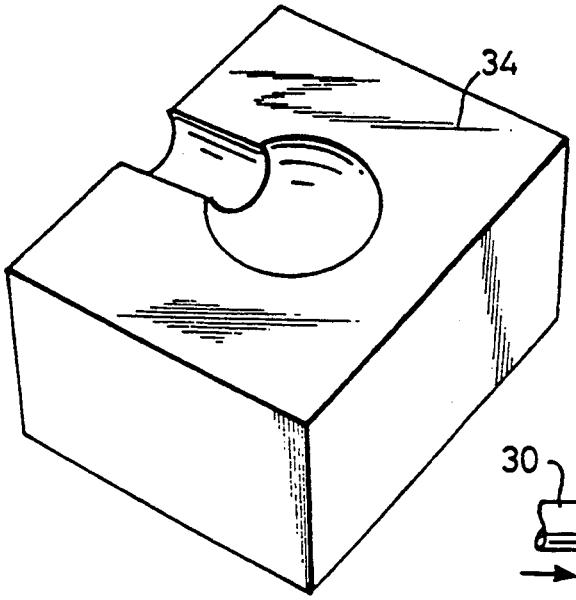
Figure 3D:
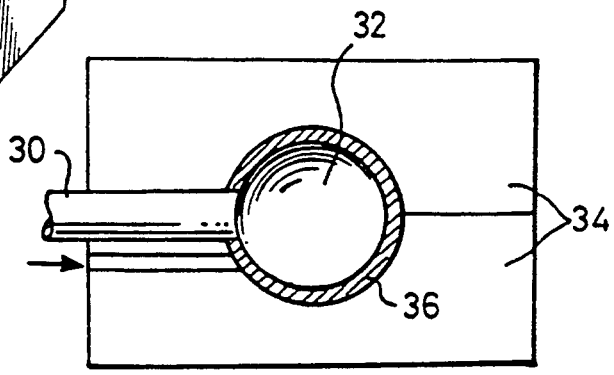

Then, as shown in FIG. 3C, the thus obtained polishing tool is supported, by the shaft thereof, between upper and lower molds 34, and, as shown in FIG. 3D, a hydrophilic monomer solution 36 is injected and polymerized.

The hydrophilic polymer gel is composed of a hydrophilic polymer with crosslinking structure. Said hydrophilic polymer is obtained from monomer units of which a major proportion is composed of hydrophilic monomer units. Examples of such hydrophilic monomer includes, in the nonionic family, acrylamides such as acrylamide, methacrylamide and N,N-dimethylacrylamide; N-vinylamides such as N-vinylformamide, N-vinylacetamide and N-vinylpyrrolidone; ethers such as methylvinylether and ethylene oxide; and alcohols such as hydroxyethyl methacrylate and vinylalcohol.

Also the examples of hydrophilic monomer in the anionic family include carboxylic acids such as acrylic acid, methacrylic acid, vinylacetic acid, maleic acid and N-carboxymethylacrylic acid; and sulfonic acids such as styrenesulfonic acid, vinylsulfonic acid and 2-acrylamido-2-methylpropane sulfonic acid.

Also the examples of hydrophilic monomer in the cationic family include amines such as dimethylaminoethyl methacrylate, dimethylaminopropyl methacrylamide, allyl amine, ethylene imine and vinylpyridine; and ammonium salts such as trimethyl-N-acryloyl-3-aminopropyl ammonium chloride, and methacryloyloxyethyl trimethyl ammonium chloride.

Also there may be employed a hydrophilic polymer containing two or more hydrophilic monomer units, if necessary.

The crosslinking structure can be given to the hydrophilic polymer by a conventionally known crosslinking method, such as a polymerizing reaction in the presence of a monomer constituting the hydrophilic polymer and a crosslinking monomer for forming crosslinks simultaneously with the polymer synthesis, or a method of applying a crosslinking agent or radiation to a polymer prepared in advance.

Examples of the above-mentioned crosslinking monomer include N,N'-methylenebisacrylamide, ethyleneglycole dimethacrylate, glycidyl methacrylate, N-methylol acrylamide and N-methoxymethyl acrylamide. Also examples of the above-mentioned crosslinking agent include formaldehyde, glutalaldehyde, cyanulic chloride, and butadiene diepoxide. Also examples of the radiation include ultraviolet light and gamma ray.

In the present embodiment, 5% aqueous solution of vinylpyrrolidone (water-soluble monomer), containing N,N'-methylene bisacrylamide in an amount of 0.2% as the crosslinking agent, is added with a suitable polymerization initiator (radical initiator) and immediated injected into the molds.

Figure 4:
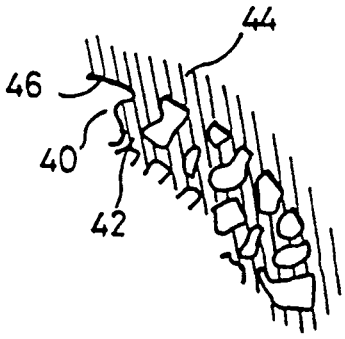

Subsequently the polymerization is initiated by heating to a suitable temperature. As shown in FIG. 4, the monomer 42 polymerizes even in the pores of the porous aluminum 40, so that the obtained gel 44 is firmly adhered to the surface of the sphere 46.

The precision of the external spherical surface of gel is relatively good as it is determined by the precision of said molds.

Figure 5:
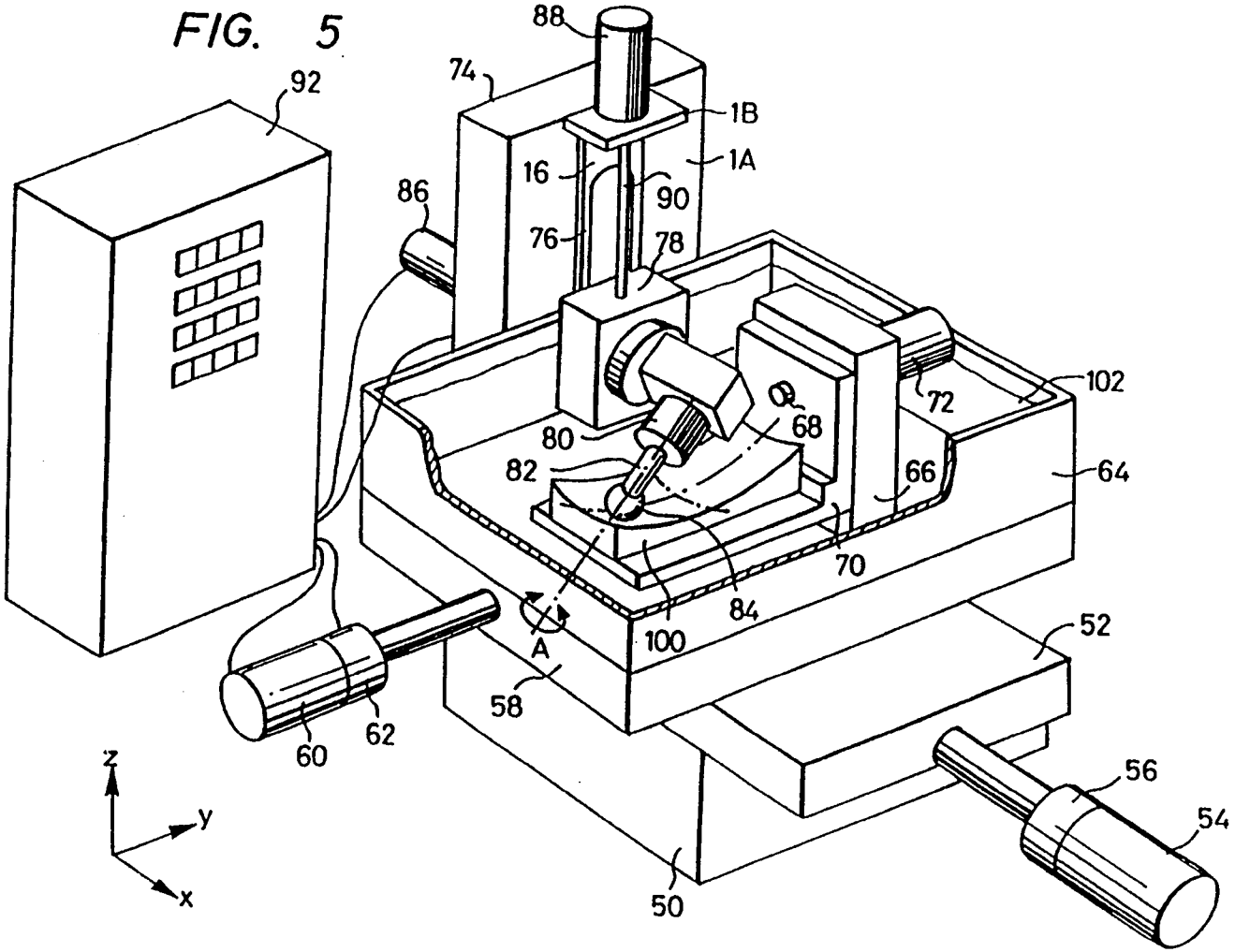
Figure 6:
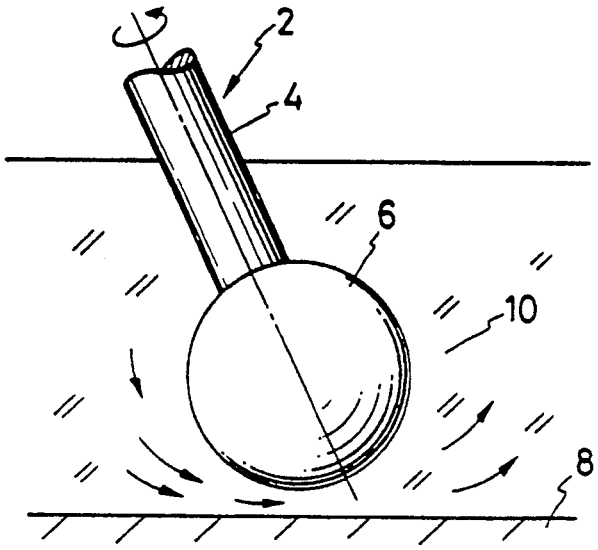
Figure 7:
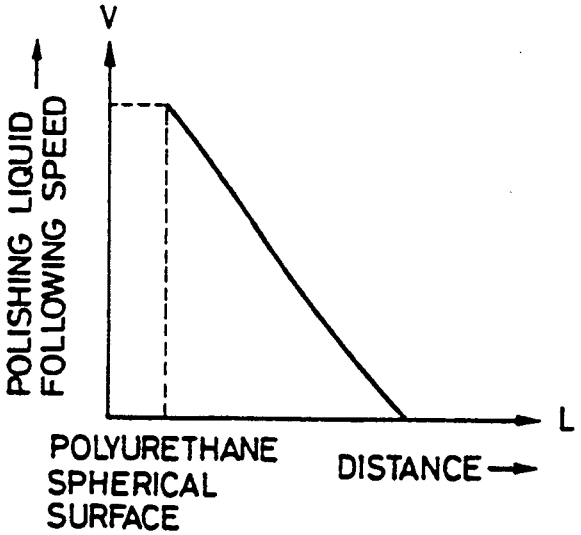

An example of actual use of the polishing tool thus prepared is shown in FIG. 5, which is a schematic view of an embodiment of the polishing apparatus for executing the polishing method of the present invention.

In FIG. 5, a base member 50 supports a Y-table 52 capable of a reciprocating motion in the Y-direction with respect to said base member 50. A motor 54, for driving said Y-table, is provided with an encoder 56 for detecting the amount of movement of said Y-table in the Y-direction. Said Y-table 52 supports an X-table 58 capable of a reciprocating motion in the X-direction with respect to said Y-table 52. A motor 60, for driving said X-table, is provided with an encoder 62 for detecting the amount of movement of said X-table in the X-direction.

A polishing tank 64 fixed on said X-table 58 supports therein a support member 66, on which mounted, by means of a shaft 68, is a work piece support member 70. Said support member 70 is L-shaped, and the shaft 68 is mounted on a vertical face thereof and is in the Y-direction. Consequently said support member 70 can rotate about the Y-direction. Said support member 66 is provided with a motor 72 of which the shaft is connected to the above-mentioned shaft 68.

On said X-table 58, and outside said polishing tank 64 there is fixed a support member 74 having a vertical guide member 76 in the X-direction, on which a polishing tool support member 78 is mounted in a vertically movable manner along said guide member. Said support member supports a motor 80 so as to be rotatable around the X-direction. The shaft 82 of said motor 80 is provided, at the lower end thereof, with a hydrophilic polymer gel layer 84. Said support member 78 is provided with a motor 86 of which shaft is connected to said motor 80 for rotating the same around the X-direction. An air cylinder 88, for vertically moving said support member 78 along the guide member 76, is provided with a rod 90 connected with said support member 78.

A control unit 92 receives the amount of movement of the Y- and X-tables from said encoders 56, 62, and controls said motors 54, 60, 72, 80, 86 and said air cylinder or motor 88.

In the polishing operation with the above-explained apparatus, a work piece 100 to be polished is fixed on the support member 70. Said work piece is finished to a predetermined surface coarseness and a predetermined shape by a preliminary working. In the present example the surface to be polished of the work piece 100 is assumed to be a concave toric surface.

An adequate amount of polishing liquid 102 is contained in the polishing tank 64.

In the above-explained polishing apparatus, the polishing tool is rotated in a direction A thereby causing a following motion in the polishing liquid 102 to polish the surface of the work piece 100.

As another embodiment of the present invention, the end portion of the polishing tool need not be spherical but can assume another form such as a semispherical form.

Also the central part of the sphere need not be a porous aluminum member.

Also said gel may be replaced by any other hydrophilic polymer when the polishing liquid is waterbased.

For a KDP ($KH_2PO_4$) single crystal used for the harmonic wave transducer, water-based polishing liquid cannot be used due to the hydroscopic property of said single crystal. However a hydrophobic gel obtained by giving a crosslinking structure to hydrophobic polymer consisting of hydrocarbon monomer units, for example a polymer obtained by single polymerization or copolymerization of styrene-butadiene rubber, isoprene rubber, isobutene rubber etc., can be used as the polishing tool of the present invention by sufficient swelling in polishing liquid based on mineral oil.

The present invention has an advantage that the polishing liquid can be applied in a wide range of applications, since the composition of the gel substance can be suitably selected according to the species of the polishing liquid.

As detailedly explained in the foregoing, the present invention can improve the efficiency of following motion of the polishing liquid, thus being capable of providing a surface with a high precision and extremely good surface smoothness.

Figure 8:
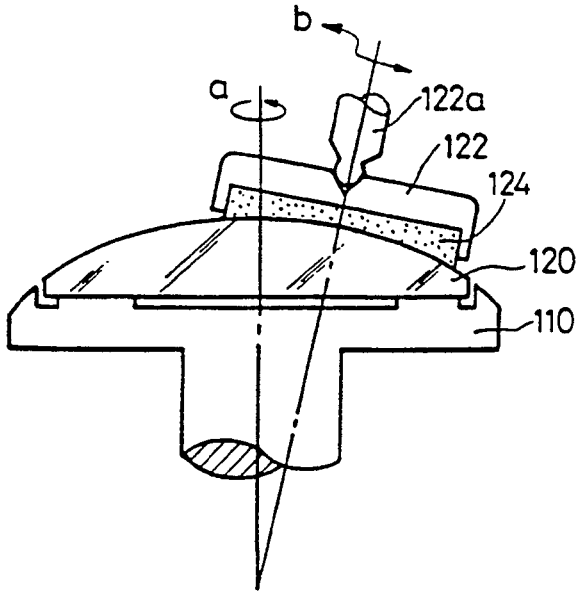

(1-2) FIG. 8 shows a variation of the embodiment employing the aforementioned gel. In this embodiment, a work piece 120 for forming a lens is fixed on a work shaft 110, which is rotated in a direction in an unrepresented polishing tank.

A support member 122 for supporting a gel substance 124 is connected to unrepresented rocking means through a rotary shaft **122*a***, and is given a rocking motion in a direction b.

Said gel substance 124 can be the same as that in the foregoing embodiment. The gel substance 124, constituting the polishing tool, is contained in a recess of the support member 122 and is pressed to the surface to be polished by said support member 122.

Example of Preparation of Polymer Gel Tool

As an example of preparation of the polymer gel, a 50% aqueous solution of vinylpyrrolidone, added with N,N'-methylene bisacrylamide in an amount of 0.2% as the crosslinking agent and a radical initiator known under a trade name V-50 supplied by Wako Junyaku Co., Ltd. was injected into a metal mold, molded under heating and then gradually cooled to room temperature.

In the present embodiment there was obtained a gel disk of a diameter of 50 mm and a thickness of 10 mm. The hydrophilic polymer gel swells in the aqueous solution, but does not lose its shape by dissolution since it is three-dimensionally crosslinked by polymerization.

When it is sufficiently swelled, it does not show an extremely large supporting force for the polishing particles as it lacks locally concentrated crosslinkings as in polyurethane, nor does it press the polishing particles against the work piece with a strong force as the polymer itself does not have a hardened portion.

Also as it is not so dense or rigid as pitch, the polymer can adapt well to an aspherical surface and can satisfactorily supply the polishing liquid.

As explained in the foregoing, the polymer gel tool of the present invention has uniform supporting ability for the polishing particles and is free from locally large supporting force for the polishing particles leading to microscratches, as the crosslinkings are three-dimensionally uniformly distributed in a relatively space manner.

Also the magnitude of the supporting force for the polishing particles can be extremely reproducibly regulated by the concentration of the aqueous polymer solution before polymerization. Also said force can naturally be regulated by the species of the monomer. It is therefore possible to obtain a tool of a supporting force for the polishing particles matching the characteristic of the work piece.

Besides, being not so rigid as pitch, the tool can be well adapted to an aspherical surface so that the size of the tool need not be made very small.

Furthermore, if the gel is formed by polymerization of an aqueous monomer solution containing the abrasive material, the tool can efficiently supply the abrasive material directly to the point of polishing, so that the efficiency of polishing can also be improved.

Other Fixing Methods of Gel

Polymer gel can be fixed to metal, particularly aluminum, in one of the following methods:

1) A porous member is impregnated with aqueous monomer solution, which is polymerized integrally in the space of said porous member;

2) The surface of a metal member (aluminum) is subjected to sand blasting with particles of silicon carbide of a particle size of 400 mesh to form minute irregularities on said surface. Subsequently the polymer gel is fixed by a polymerization similar to that in the preceding item (1):

3) The surface of a metal member (aluminum) is subjected to a silinization process, utilizing a methacrylate silane coupling agent, to directly crosslink the gel to said surface;

4) The surface of a metal member (aluminum) is etched with dilute hydrochloric acid to form minute irregularities on said surface and to simultaneously activate said surface, and the polymer gel is fixed to said surface by a polymerization similar to that in the item (1);

5) The surface of a metal member (aluminum) is oxidized with an aqueous chromate solution or ozone gas, and the polymer gel is fixed in a similar manner as in the item (1).

These methods (1)–(5) may be employed individually, but may also be employed in various combination for achieving stronger fixation of the polymer gel onto the metal member. For example a combination of methods (1) and (3), (1) and (4), or (1) and (5) allows to crosslink the polymer gel onto the surface of the metal member and to realize interlocking of the metal porous member and the polymer gel structure.

Also effective is a combination of methods (2) and (3), (2) and (4), or (2) and (5).

Furthermore, other embodiments of the method of making the support member shown in FIG. 8 and of the method of fixing a gel are described as follows. On a surface of an aluminum plate (support member 122) having an edge shown in FIG. 8, minute surface irregularities are formed by sandblasting. Then, after the support member is oxidized at a positive pole with current density of 7 mA/cm$^2$ in 0.1 mol oxalic acid aqueous solution and is rinsed, the support member is abluted by absolute ethanol and is desiccated. Next, after the support member is immersed in silane coupling, i.g. 1% wt. aqueous solution of trade name KBM 503 (made by Shinetsu Chemical Co., Ltd.), and is naturally desiccated, and the support member is heated at 110° C. during 10 minutes.

By the above treatment, the support member 122 obtains a surface for supporting a gel material.

Moreover, several methods of fixing a gel material to the support member 122 treated as above are set forth as follows.

6) A space (space cavity) into which the gel material is poured is formed between an upper mold (not shown) and a lower mold which is the support member 122.

Nitrogen gas is blown into aqueous solution comprising 35% wt. N-vinylpyrrolidone and 0.5% wt. triethyleneglycole dimethacrylate with stirring during about 30 minutes. The above aqueous solution into which nitrogen gas is blown is poured into said space, and the upper and lower molds are heated at 95° C. during 10 minutes. After heating, a gel material fixed to the support member 122 is found by detaching the upper mold.

7) Aqueous solution comprising 26% wt. acrylamide and 0.4% wt. N,N'-methylene bisacrylamide is deaired with reduced pressure to eliminate air in the aqueous solution. Ammonium persulfuric acid is dissolved into the above aqueous solution in order to obtain 0.2% wt. aqueous solution thereof. The new aqueous solution is poured into said space (described in the item (6)), and after the upper and lower molds are heated at 65° C. during 8 hours, a gel material is fixed to the support member.

8) Aqueous solution comprising 35% wt. N-methyl acrylamide and 0.4% wt. N,N'-methylene bisacrylamide is deaired with reduced pressure. 0.2% wt. ammonium persulfuric acid and 0.4% wt. $\beta$-dimethyl aminopropio nitrile are added to the above aqueous solution, and the new aqueous solution is poured into between the molds. After the molds are left as they are at about 20° C. during 3 hours, a gel material is fixed to the support member.

9) Aqueous solution comprising 5% wt. polyvinylalcohol having about 2000 average polymerization degrees, 8% wt. hydroxy ethylmethacrylate and 2% wt. polyethyleneglycole is deaired with reduced pressure. 0.3% wt. ammonium persulfuric acid is added to the above aqueous solution, and the new aqueous solution is poured between the molds. After the molds are heated at 70° C. during 10 hours, a gel material is fixed to the support member.

10) Example of a gel based on mineral oil.

The support member 122 described in the item (6) is immersed in 5% wt. toluene aqueous solution of silicone resin 9 trade name TSE325 made by Toshiba Silicone Co., ltd.) and is desiccated, and the support member is heated at 140° C. during 3 hours. Molds in which is poured aqueous solution described as below comprise the support member (lower mold) and the upper mold. 50% wt. toluene aqueous solution of silicon resin (trade name YE5822 made by Toshiba Silicone Co., Ltd.) is poured into a space in the molds, and after the molds are heated at 35° C. during 24 hours, a gel material is fixed to the support member.

According to the methods (6) to (10) described above, a gel disk having about 80 mm diameter and about 10 mm thickness and being formed of a gel material was obtained, with being fixed to the support member 122. An example of polishing a synthetic quartz by a polishing method shown in FIG. 8 with using this gel disk is described below.

A material of the synthetic quartz had 170mm diameter and 25 mm thickness and had a convex shape of 500 mm carvature radius. The synthetic quartz was supported on the work shaft 110 shown in FIG. 8, and it was polished by the support member fixing the gel material obtained by the method (6), (7), (8), (9), or (10).

| Polishing condition | |
|---|---|
| Rotation speed of the synthetic quartz | 4 r.p.m. |
| Cycle of rocking the support member | 8 cycles/min. |
| Range of rocking the support member | ±20 mm |
| Load | 10 gf/cm$^2$ |

Polishing liquid consisted of water of 5 l dissolving cerium oxide of 5 grams. Average diameter of polishing particles was 0.3 μm.

Surface coarsenesses before polishing and after starting of polishing at every 1 hour were measured by HETERODYNE PROFILER 5500 made by ZYGO Co. in U.S.A. Table 1 shows results of the measurement. The surface coarseness became better.

In the same experiment with using blown asphalt pitches (flex temperature 110° C.), the surface coarsenesses became better but were worse than the case with using the gel disk, and some scratch marks were found on the work surface through an interference microscope (type Nomarsky: X400). Therefore, by polishing with using the gel disk, the surface coarseness of 5 ÅP-V was attained, and scratch marks which were apt to occur with using blown asphalt pitches were not found.

TABLE 1

| polishing time | 0 Hr | 1 Hr | 2 Hr | 3 Hr | 4 Hr |
|---|---|---|---|---|---|
| with using the gel disk P-V value | 30–25 Å | 12–10 Å | 8–6 Å | 6–4 Å | 5–4 Å |
| with using blown asphalt P-V value | 30–25 Å | 18–15 Å | 17–13 Å | 14–11 Å | 13–10 Å |

When the polymer gel is to be fixed to a metal, the metal surface is preferably subjected to a treatment to enhance the adhesion of polymer gel such as:

1. Use of porous metal member;
2. Forming surface damages by sand blasting; or a treatment to facilitate crosslinking of the polymer gel such as:
3. Silane coupling treatment on the surface;
4. Acid etching; or
5. Oxidation with chromate or ozone.

Examples Other than Hydrophilic Gel

Aqueous polishing liquid cannot be used for a KDP ($KH_2PO_4$) single crystal used in the harmonic wave conversion device, since said crystal is deliquescence. For this reason a hydrophobic polymer, obtained by polymerization or copolymerization of hydrocarbon monomers, such as styrene-butadiene rubber, isoprene rubber or isobutene rubber, was employed in a swelled state in polishing liquid based on a mineral oil. Diamond powder was employed as the abrasive material. In this manner there can be employed a desired surface smoothness and a desired surface state. In the polishing liquid based on mineral oil, the pitch is dissolved therein and cannot therefore be used as the tool. Also polyurethane sheet cannot be used as the tool as the adhesive used for adhesion with the support member is dissolved in the liquid. In this manner the composition of the gel substance can be suitably selected according to the nature of the polishing liquid, so that the field of application of the present invention is wider than that of the conventional polishing method with pitch or polyurethane sheet.

As explained in the foregoing, the present invention, employing a polymer gel substance as the polishing tool, is applicable not only to the polishing of spherical, aspherical or flat surfaces, but also to that of an arbitrarily curved surface such as continuous or uncontinuous surface.

Figure 9:
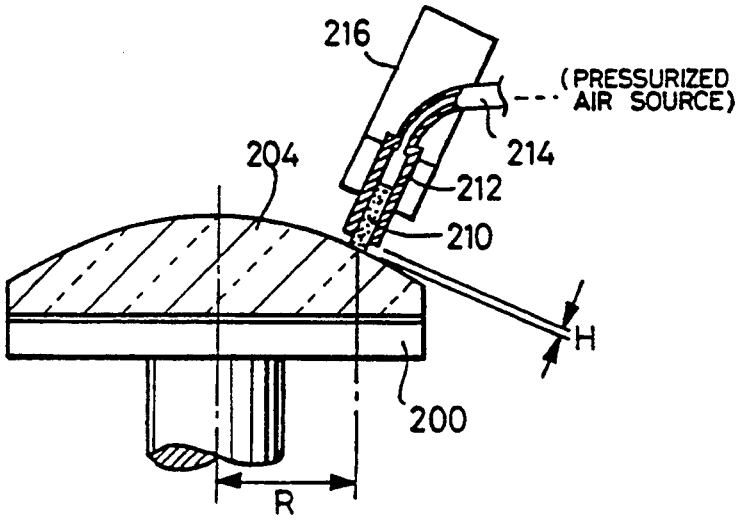
FIGS. 9 and 10 are cross-sectional views showing other embodiments employing a viscoelastic member such as pitch as the polishing tool.
Figure 10:
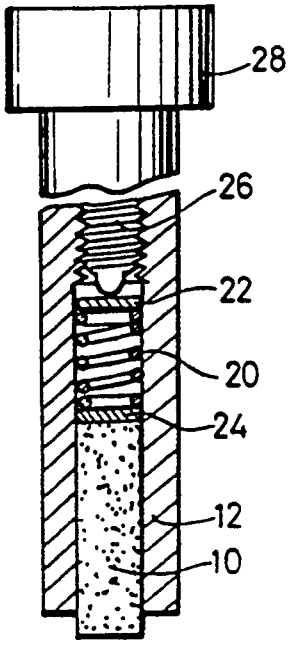

(1-3) FIGS. 9 and 10 illustrate still another embodiment.

In these embodiments there is provided a polishing apparatus in which a rod-shaped soft polishing tool is supported in a tubular member and is pushed from an end thereof so as to be pressed to a work piece, and the polishing operation is conducted by maintaining the distance between the end of said tubular member and the work piece so small that the protruding portion of said tool does not substantially cause deformation in the radial direction under said pressure.

Now the present embodiment will be clarified in detail while making reference to FIGS. 9 and 10.

In FIG. 9, schematically showing the polishing method of the present embodiment, work piece support means 200 is rotated about a vertical axis by unrepresented driving means, and a work piece 204 to be polished is fixed on said support means 200. In the illustrated example, said work piece is polished at the upper surface which is a rotary symmetric convex aspheric surface.

A soft polishing tool 210 is formed as an oblong rod with a circular section. The diameter of said tool is suitably selected according to the desired area of polishing, but is generally in a range of 1–5 mm. Said tool is conveniently composed of a viscoelastic material such as pitch. Said polishing tool is contained in a tubular holder 212 in an axially movable manner. Said tubular holder 212 is open at the lower end thereof, and is connected, at the upper end, to an air pipe 214 which is in turn connected to a pressurized air source.

Said tubular holder 212 is fixed at an end of a numerically controlled moving arm 216.

In the polishing operation, said moving arm 216 is suitably controlled to move the tubular holder 212 to a position corresponding to an annular area of a desired distance R from the rotary center of the work piece 204 and to maintain said holder at a predetermined angular position. The shape of the work piece is measured in advance, and the gap H between .the lower end of the holder 212 and the surface to be polished is maintained as small as possible, for example 0.1 to 0.2 mm.

Then air of a suitable pressure is introduced into the holder 212 from the pressurized air source through the air pipe 214, thereby causing the polishing tool 210 to protrude from the lower end of the holder and pressing said tool against the surface to be polished, under a desired pressure, for example 100–1,000 g/cm$^2$.

The work piece 204 is rotated by the support means about the vertical axis, and the abrasive material is supplied to the position of polishing by unrepresented supply means.

In this manner a desired annular area of the surface is polished. If a neighboring annular area is to be polished in succession, the polishing tool support member 212 is suitably moved by the arm 216 with suitable angular control and with suitable control of air pressure.

In the above-explained embodiment, the polishing tool is automatically pushed from the holder 212 as it is abraded in the course of the polishing operation and is pressed to the work piece under a constant pressure, thereby maintaining constant polishing condition.

In the present embodiment, a lubricant may be applied on the external periphery of the polishing tool 210 in order to improve the slidability and the sealing ability between said tool 210 and the holder 212.

Also in the present embodiment the gap H between the lower end of the holder 212 and the surface to be polished should be as small as possible, but said gap H may be increased, according to the hardness of the polishing tool and the pressure applied thereon, as long as the polishing tool does not show deformation in the lateral direction (along the surface to be polished) under said pressure.

This embodiment is particularly suitable for a correction polishing.

FIG. 10 is a partial cross-sectional view of a variation of the above-explained embodiment, in the vicinity of the polishing tool holder.

In FIG. 10, the polishing tool 210 is the same as that shown in FIG. 9, and is contained in a tubular holder 212 in such a manner it can slide in said holder and protrude from the lower end thereof. In said holder and above said tool there is provided a coil spring 220, sandwiched between upper and lower plates 222, 224. Above said upper plate 222 a female screw is formed in the holder 212 to engage with a feed screw 226 which is connected to the shaft of a motor 228 mounted above said holder 212.

In the present embodiment, the rotation of the motor 228 moves the feed screw 226 downwards, thereby compressing the spring 220 and causing the polishing tool 210 to protrude from the lower end of the holder 212 under a predetermined pressure.

Also in the present embodiment, said tool holder 212 is fixed on a moving arm for positional and angular control.

The present embodiment also provides the same advantages as in the foregoing embodiment.

In the foregoing description pitch is employed as the polishing tool, but any other material may be employed as the tool in the present invention as long as it is soft enough to adapt to the surface form of the surface to be polished when it is pressed to said surface.

In the present embodiment, the size of the abrasive particles contained in the polishing tool may be suitably determined according to the desired surface smoothness, from a very small size for obtaining an optical surface to a size for obtaining a matted surface or even to a size for obtaining so-called ground surface.

The foregoing embodiment is featured by holding a rod-shaped soft polishing tool in a tubular holder, causing said tool to protrude slightly from said holder and pressing said tool to a surface to be polished under a predetermined pressure, thereby effecting a polishing operation, Consequently the tool is free from deformation in the radial direction even when the contact area of the tool with said surface is made small. Also said tool adapts to said surface and maintains satisfactory contact therewith by the pressure applied to said tool. Consequently it is rendered possible to effect polishing of a small area in an efficient manner, fully utilizing the service life of the tool and without damaging the surface to be polished, and to realize satisfactory surface shape and precision in easy manner.

FIGS. 11 to 18 illustrate embodiments for achieving the second object of the present invention.

Figure 11:
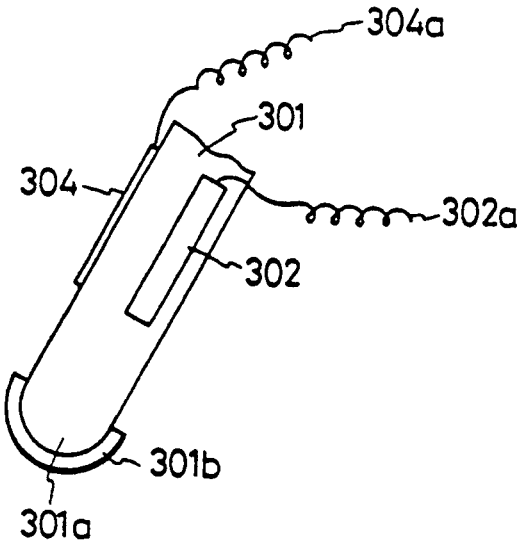

FIG. 11 shows a polishing tool to be employed in the present embodiment, in which a polishing sheet 301*b* is fixed to an end 301*a* of a rotary shaft 301, and displacement sensors 302, 304 such as force sensors or strain sensors are fixed on said shaft.

Figure 12:
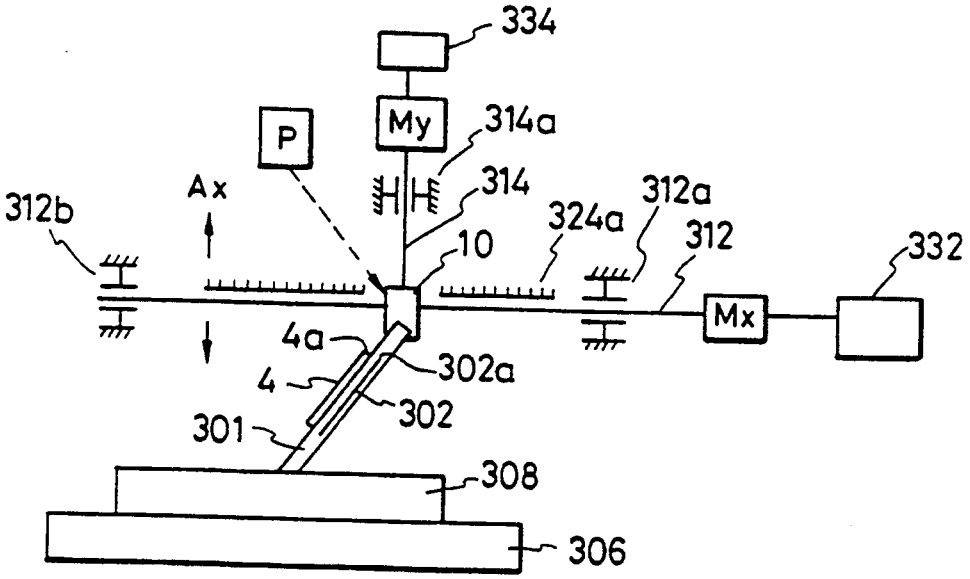

FIG. 12 shows an apparatus of the present embodiment, in which a work piece 308 is placed on an X-Y table 306. movable in the X- and Y-directions. A holder 10, for a polishing tool 301, engages with a feed screw 312 in the X-direction, connected to an X-direction moving motor Mx. Bearings 312*a*, 312*b* are provided for the feed screw 312. A feed screw 314 for moving the holder 10 in the Y-direction is connected to a Y-direction moving motor My. A bearing 314*a* is provided for said feed screw 314. There are also provided a cylinder unit P for applying pressure on the holder 310 or the polishing tool 301, and a magnetic scale 324*a* to be explained later.

Figure 13:
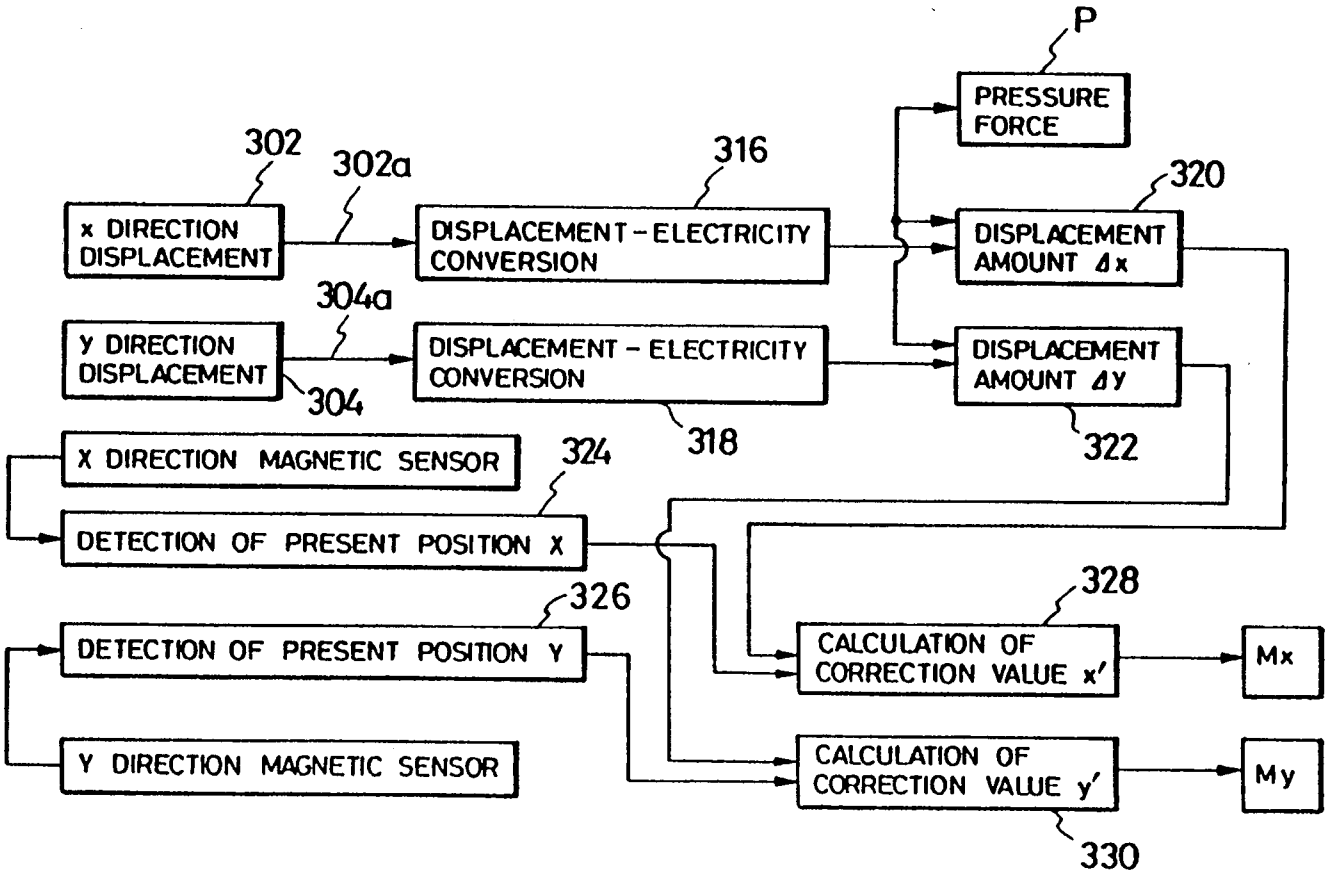

FIG. 13 is a block diagram of a control system employed in the present embodiment. Converter means 316, 318 receive the signals of the displacement sensors fixed on the rotary shaft 301 and convert the amounts of displacement into electric signals. Means 320, 322 receive the signals of said converter means 316, 318 for calculating the amounts of displacement $\Delta x$, $\Delta Y$ of the working position of the end of the polishing tool. More specifically, said calculating means 320, 322 receive the amounts of displacement obtained from said sensors 302, 304 when a reference pressure is applied to the polishing tool and the amounts of displacement under the pressure actually applied to the tool and calculates the amounts of displacement $\Delta x$, $\Delta y$ of the end of the polishing tool from the relationship of the reference pressure and the actual pressure.

Blocks 324, 326 are used for detecting the set position of the polishing tool 301 in the X- and Y- directions. Said block 324 is provided with a magnetic scale 324*a*, while the polishing tool or the holder therefor is equipped with a magnetic sensor to detect the amount of movememt of the tool from a reference position. The output of the sensor, obtained by counting the magnetic gradations of the magnetic scale 324*a*, is supplied to an X-direction position detecting block 324 to calculate the amount of movement of the tool from the reference position.

The Y-direction position detecting block 326 detects the amount of movement of the tool in the Y-direction from a reference position, by means of an unrepresented magnetic scale positioned parallel to the Y-direction feed screw 314 and a magnetic sensor fixed on the holder 310.

Calculating blocks 328, 330 for calculating the amounts of correction in the X- and Y-directions calculate the correction amounts $\Delta x$, $\Delta y$ from the displacement signals and the set position signals of the tool, for controlling the motors Mx, My.

In the following there will be explained the function of the above-explained apparatus. At first the work piece 308 is fixed on the table 306, and the polishing tool is moved from a reference position in the X- and Y-directions to a working position.

The shape to be obtained is compared with the present shape of the work piece in advance to determine the positions of correction polishing, and the obtained data is supplied to control circuits 332, 334 for the X- and Y-direction motors Mx, My thereby activating said motors and setting the polishing tool to a working position.

Then the polishing tool 301 is pressed by the cylinder unit P onto the surface to be polished, and the polishing operation is conducted by the rotation of the tool or the work piece, eventually combined with the supply of polishing liquid from an unrepresented nozzle.

Figure 14:
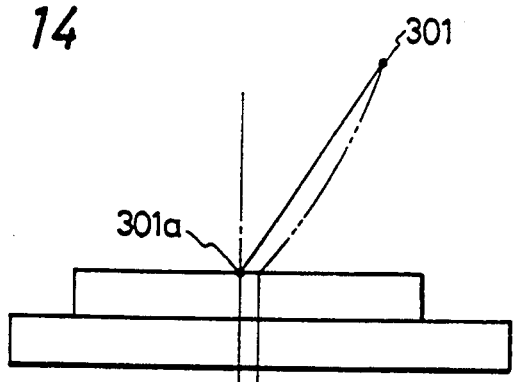
Figure 15:
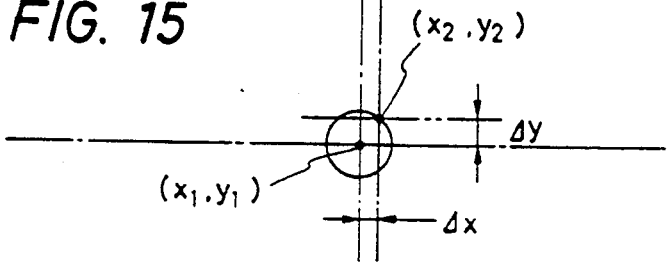

When the polishing operation is started, the polishing tool 301, maintained under the aforementioned pressure, is displaced, as shown in FIG. 14, from a solid-lined initial set position ($x_1$, $y_1$) to a position ($x_2$, $Y_2$).

The displacement sensors 302, 304 on the polishing shaft detect the displacements in the X- and Y-directions. The amounts of said displacements are converted into electric signals by the blocks 316, 318, and signals corresponding to $\Delta x$, $\Delta y$ are obtained from the blocks 320, 322.

The blocks 320, 322 are preferably so constructed as to store the data of displacements corresponding to predetermined pressures, $P_0$, $P_1$, $P_2$ . . . and to provide the amounts of displacement $\Delta x$, $\Delta y$ in response to the pressure applied to the displacement sensors.

The blocks 324, 326 determine the amounts of movement of the polishing tool 301 from unrepresented predetermined position Ax, Ay in the X- and Y-directions to the working position, by means of the magnetic scales and magnetic sensors.

The correction value calculating blocks 328, 330 calculate the input signal to the motors Mx, My for returning the polishing tool to the set position, compensating the displacements $\Delta x$, $\Delta y$, based on the signals from the detecting blocks 324, 326 and from the displacement calculating blocks 320, 322, and accordingly drive the motors Mx, My to displace the polishing tool to the predetermined set-position.

In the foregoing explanation the correction of position is achieved by moving the polishing tool, but it can also be achieved by moving the X-Y table 306, supporting the work piece 308, according to the signals from the correction value calculating blocks 328, 330 shown in FIG. 13.

As explained in the foregoing, the present embodiment allows, even when the polishing tool is displaced from an originally selected working position, to detect such displacement with sensors and to correct the working position of the polishing tool in response to the detected displacement, thereby maintaining the tool always at the correct working position.

Figure 16:
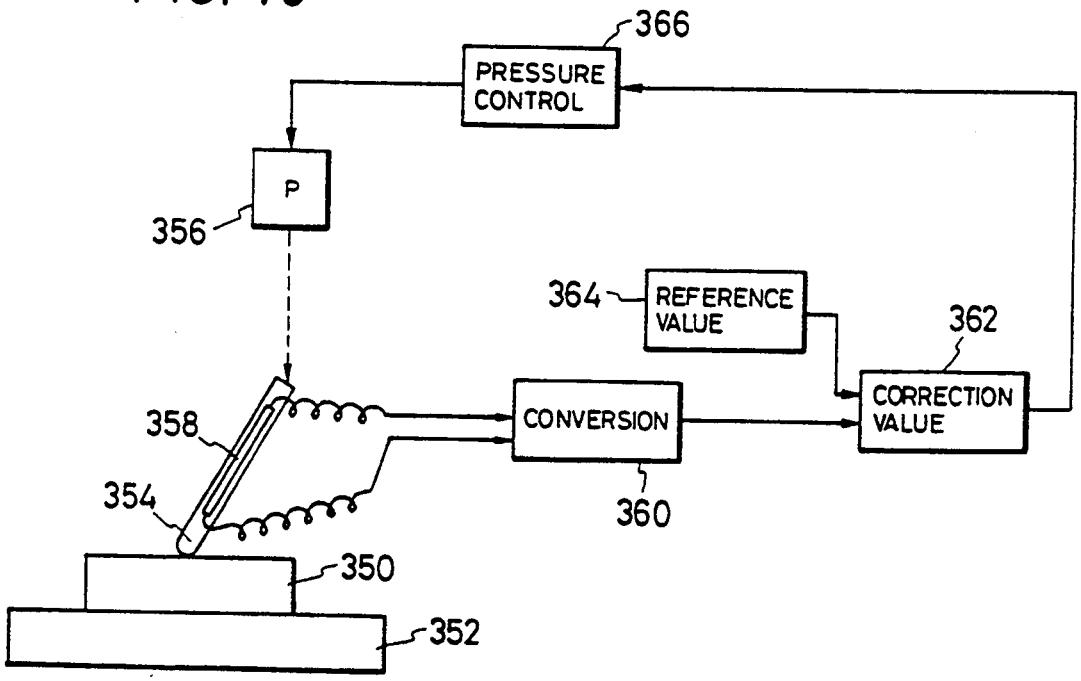

FIG. 16 shows another embodiment for achieving the second object of the present invention.

In order to polish a work piece to a surface coarseness of the order of an Angstrom, it is necessary to precisely control the pressure of the polishing tool applied to the work piece. For example, when the polishing tool moves from a less coarse position to a more coarse position or in an opposite direction, the pressure applied to the surface to be polished varies, thus affecting the polishing ability of the tool, so that an expected polished surface cannot be obtained.

Such variation in the polishing pressure significantly affects the performance in minute polishing.

In consideration of the foregoing, the present embodiment detects the polishing pressure applied to the polished surface of the work piece, converts said polishing pressure into an electric signal, and supplies said electrical signal to a pressure regulator for supplying the polishing tool with a polishing pressure matching the shape and coarseness to be obtained, thereby controlling the polishing pressure in response to said electrical signal.

FIG. 16 shows the structure of the present embodiment, in which shown are a work piece 350 fixed on a support table 352; a polishing tool 354; and pressurizing means such as an air cylinder 356 for applying the polishing pressure onto said polishing tool 354.

A displacement sensor 358 such as a force sensor or a strain sensor, mounted on the polishing tool, is provided for detecting the displacement such as bending or strain caused in the polishing tool 354 by the pressure of the pressurizing means 356.

Converter means 360 detects the amount of displacement of the polishing tool from the signal of said sensor 358, and the output of said converter means is supplied to correction value calculating means 362.

Reference signal generating means 364 generates an electrical comparison signal corresponding to a reference pressure, by determining the relationship between the polishing pressure and the amount of displacement of the polishing tool, based on the relation among the desired surface coarseness of the polished surface, the polishing ability of the tool and the polishing pressure, and calculating the amount of displacement in response to the change in pressure. Said comparison signal is supplied to the correction value calculating means.

Pressure regulating means 366 for the pressurizing means 356 receives the signal from said correction value calculating means 362.

In the following there will be explained the function of the apparatus explained above.

At first the work piece 350 is placed on the support table 352, and the polishing tool 354 is set on the surface to be polished of said work piece.

The polishing tool 354 is pressed to the polished surface by the air cylinder of the pressurizing means 356 according to the predetermined shape to be obtained. Then the polishing operation is conducted by the rotation of the table 352 and the work piece 350 or the polishing tool 354.

In the conventional pressurizing means, a piston rod of an air cylinder is connected to the polishing tool, and the pressure control is conducted by a control valve such as an electromagnetic valve, so that the pressure of said pressurizing means is transmitted to the work piece through the polishing tool.

The pressure applied to the work piece is influenced by various factors such as the shape of the work piece, rotating speed of the work piece and the tool, peripheral speed thereof, species and polishing ability of the tool etc. so that it is not clear whether the calculated pressure is actually applied to the surface to be polished.

In the present embodiment a displacement sensor 358 such as a force sensor or a strain sensor is mounted on the shaft of the polishing tool, thereby detecting the variation in pressure between the polishing tool and the work piece.

The output of said sensor 358 is supplied to the converter means 360 for converting the amount of displacement into a corresponding electrical signal.

The output of the converter means 360 is supplied to an input terminal of the correction value calculating means 362, of which the other input terminal receives the output of the reference signal generator 364. In response to the predetermined pressure and the amount of displacement, the correction value calculating means 362 supplies the pressure regulator 366 wit$_h$ a correction signal for the pressure corresponding to the amount of displacement.

In response to said correction signal, the pressure regulator 366 controls the function of the electromagnetic valve, thereby regulating the pressure of the pressurizing means 356. The regulated pressure is transmitted to the polishing tool, thereby correcting the displacement of the shaft, whereby the regulated pressure is correctly applied to the work piece.

In the course of the polishing operation under the pressure regulated by the pressure regulator, if the pressure is varied by some reason, the displacement sensor 358 again detects the variation in the pressure and the pressure is regulated as explained above.

As explained in the foregoing, the present embodiment is featured by detecting the variation in the polishing pressure applied to the work piece by means of the displacement sensor 358, calculating a correction value for the pressure based on the displacement signal and controlling the pressure with a pressure regulator, thereby precisely controlling the polishing pressure which has a significant effect on the precision of polishing, and thus improving the precision of polishing.

Figure 17:
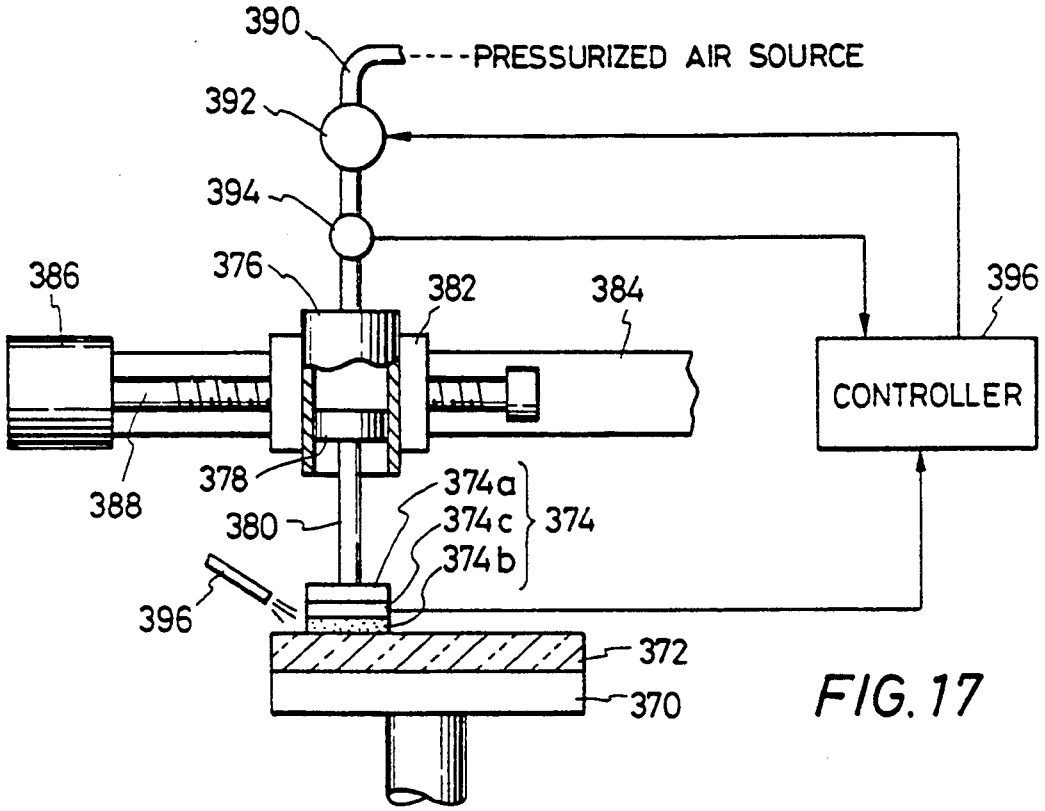
Figure 18:
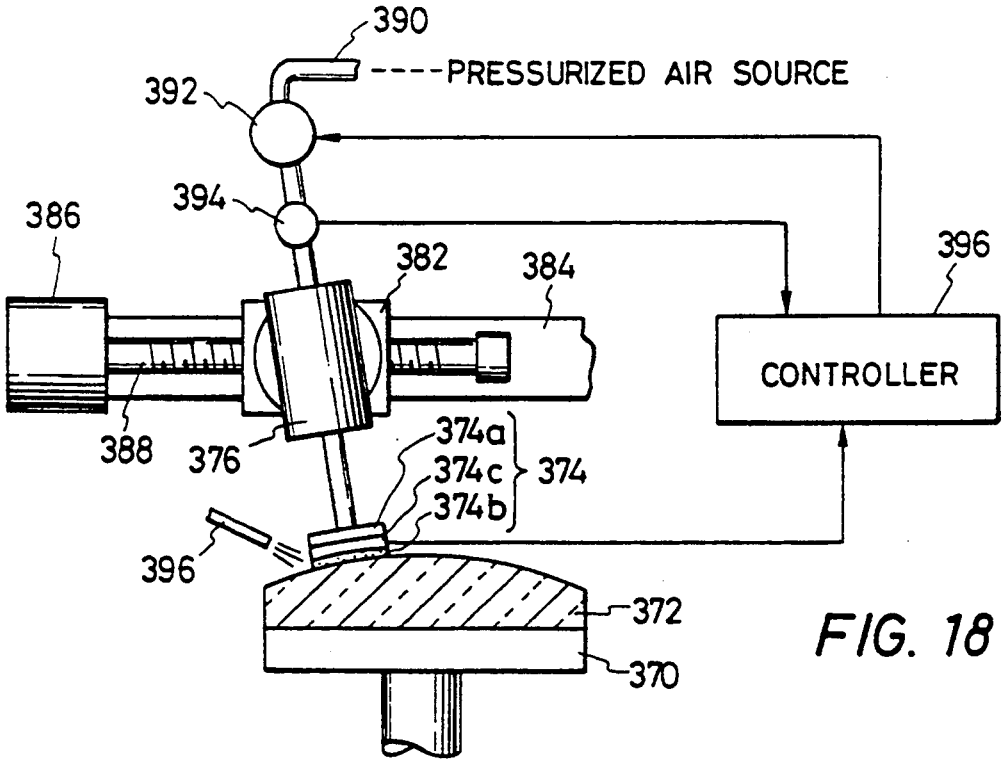

FIGS. 17 and 18 illustrate another embodiment for achieving the second object of the present invention.

For responding to the requirements for improved optical performance and for special functions in recent years, there is being produced optical elements with so-called aspherical surfaces other than the conventional flat and spherical surfaces. Such aspherical surfaces include not only surfaces rotationally symmetrical about the optical axis but also those asymmetrical about the axis. Such aspherical surface is formed by grinding under numerical control, and then by polishing for reducing the surface coarseness while maintaining the precision of the surface shape. In the preparation of such aspherical surfaces, correction polishing is often needed since the surface precision is easily deteriorated.

Also in such correction polishing, the amount to be abraded is controlled by suitably regulating the pressure of the polishing tool, so as to bring the surface shape toward the desired one.

Such pressure control for the polishing tool is generally achieved by applying a desired pressure to the polishing tool by means of pressurizing means such as an air cylinder. In order to maintain a correct pressure, a pressure servo valve is provided between said air cylinder and a pressurized air source for supplying pressurized air to said cylinder, and an air pressure detector is provided between said servo valve and said air cylinder, wherein said pressure servo valve is suitably regulated according to the pressure detected by said detector, in such a manner that said detected pressure is maintained at a desired value.

However, in such conventional pressure control system, when the contact position of the polishing tool moves on the surface to be polished, the pressure in the cylinder may not be transmitted to the work piece through the tool due to the presence of friction of the piston in the cylinder, so that the pressure of the tool on the work piece cannot be exactly set at a desired value. Consequently it has been difficult to bring the surface shape of the work piece to the desired shape with satisfactory precision.

Therefore the present embodiment is to press the polishing tool to the work piece with a desired pressure, thereby realizing satisfactory polishing under precise polishing conditions.

In the following there will be explained the present embodiment, while making reference to FIG. 17 illustrating a polishing apparatus of said embodiment.

In FIG. 17, work piece support means 370 is rotated by unrepresented driving means about a vertical axis, and a work piece 372 is fixed on the upper face of said support means 370. In the present embodiment, said work piece is a plate member having parallel flat faces, which are ground to a suitable surface coarseness by a previous working step.

A polishing tool 374 is composed of a substrate 374*a*, a polishing sheet 374*b* maintained in direct contact with the work piece (for example a foamed polyurethane sheet of a thickness of 0.5–1.0 mm), and pressure detector means 374*c* positioned between said polishing sheet and said substrate 374*a*. Said pressure detector can be composed for example of a load cell utilizing a piezoelectric material.

The polishing tool 374 is pressed to the work piece 372, by means of an air cylinder 376 in the present embodiment, provided with a piston 378 and a piston rod 380. Said rod is positioned vertically, and is connected, at the lower end thereof, to said substrate 374*a* of the tool.

Said air cylinder 376 is fixed to a support member 382, which is horizontally movably guided by a guide member 384. On said guide member there is mounted a motor 386 of which the shaft is connected to a horizontal feed screw 388 positioned along said guide member 384. Said feed screw engages with the support member 382 for the air cylinder, so that said support member 382 is moved along the guide member 384 by the rotation of the screw 388 by the motor 386.

Said air cylinder is connected, through a pipe 390, to a pressurized air source, and a pressure servo valve 392 is positioned in said pipe. Between said air cylinder and said servo valve 392 there is provided an air pressure detector 394.

A pipe 396 is provided for supplying polishing liquid between the work piece 372 and the polishing tool 374.

The output of the pressure detector 374*c* of the polishing tool and the output of said air pressure detector 394 are supplied to a controller 396, which supplies said servo valve 392 with an instruction signal for controlling valve aperture.

In the polishing operation, the abrasive material is supplied to the polishing position from the supply pipe 396, and the work piece support means 370 is rotated. The feed screw 388 is rotated by the motor 386 to horizontally move the air cylinder 376 along the guide member 384, thereby displacing the polishing tool 374 to a desired radial position of the work piece 372.

The above-mentioned pressurized air source has a constant pressure for example of 5 kg/cm$^2$, and the air pressure supplied to the air cylinder 376 is suitably controlled by the aperture of the pressure servo valve 372. The controller 396 generates an instruction signal for controlling the aperture of the servo valve 392 in order to achieve a desired air pressure.

The pressure supplied to the air cylinder 376 is transmitted through the piston rod 380 to the polishing tool 374, whereby the polishing sheet 374*b* is pressed to the work piece 372 with a suitable pressure. The counterpressure of said pressure is detected by said pressure detector 374*c* and is supplied to the controller 396. If said detected pressure is different from the pressure predetermined for desired polishing of said polishing position, said controller 396 releases an instruction to the servo valve 392 for varying the valve aperture so as to cancel said pressure difference. The air pressure detector 394 constantly supplies the detected air pressure to the controller 396, thereby controlling said servo valve 394.

The pressure detected by said pressure detector 374*c* is sampled at a suitable time interval to correct the deviation from the desired value, and, in this manner the polishing operation is conducted with an extremely exact pressure, thus realizing a desired polishing speed, a surface coarseness and a precision of surface shape.

In such polishing operation, the desired pressures can be suitably set corresponding to the stages and positions of polishing. The desired polishing operation can be conducted by moving the polishing tool by the motor 386 in the radial direction of the work piece 372 and pressing the polishing tool 376 to the work piece 372 with the predetermined pressure corresponding to the change in the polishing position.

FIG. 18 shows a variation of the foregoing embodiment, in which the same components as those in FIG. 17 are represented by same numbers.

In the present embodiment the surface to be polished of the work piece 372 is spherically convex, and the polishing tool 374 has a correspondingly curved shape. The air cylinder 376 is mounted on a support member 382 rotatably about the horizontal axis which is perpendicular to the vertical direction and to the direction of the guide 384, and the inclination angle is determined by unrepresented driving means.

In the present embodiment, while the polishing tool 374 is moved by the motor 386 in the radial direction of the work piece 372, the piston rod 380 is always controlled to be directed toward the center of curvature of the polished surface, so that the polishing sheet 374*c* is always adapted to the polished surface.

This embodiment can also provide the same advantages as in the foregoing embodiment.

In these embodiments, the size of the abrasive particles contained in the polishing material can be suitably determined according to the desired surface coarseness, and can vary from a small size for obtaining an optical surface to a particle size for obtaining a matted surface or a coarse ground surface.

Though the foregoing embodiments showed polishing with free particles, the present invention is likewise applicable to the polishing with fixed abrasive particles.

As explained in the foregoing, the present embodiment is featured by a fact that the counterpressure to the pressure of the polishing tool on the polished surface is directly detected and used for controlling said pressure, so that the tool can be pressed to the work piece with a desired pressure to achieve a satisfactory polishing operation under desired precise polishing conditions.

FIGS. 19 to 27 illustrate embodiments for achieving the third object of the present invention.

In these embodiments there is provided a liquid polishing apparatus provided with a work piece having a surface to be polished and a polishing tool, which are so mutually positioned, in a tank of polishing liquid containing minute polishing particles of different sizes, that they can be maintained in a continuous manner at suitable relative positions and angles with an appropriate mutual polishing pressure therebetween; means for continuously maintaining said relative positions and angles of the polishing tool and the surface to be polished; and means for numerically controlling said means for maintaining the positions and angles, wherein said polishing liquid tank is provided therein with means for distributing said polishing particles in a laminar manner according to the specific gravity and size thereof.

In the apparatus of the present embodiment, the polishing particles of different specific gravities and sizes, mixedly present in the polishing liquid, are classified into different layers according to these properties, so that a satisfactory coarseness of the polished surface can be obtained by placing the position of polishing at a suitable layer of polishing particles. Also a high and stable working efficiency can be achieved since the desired polishing particles are supplied, in stable manner, to the polishing position.

In the following there will be explained the embodiments of liquid polishing process and an apparatus therefor.

Figure 19:
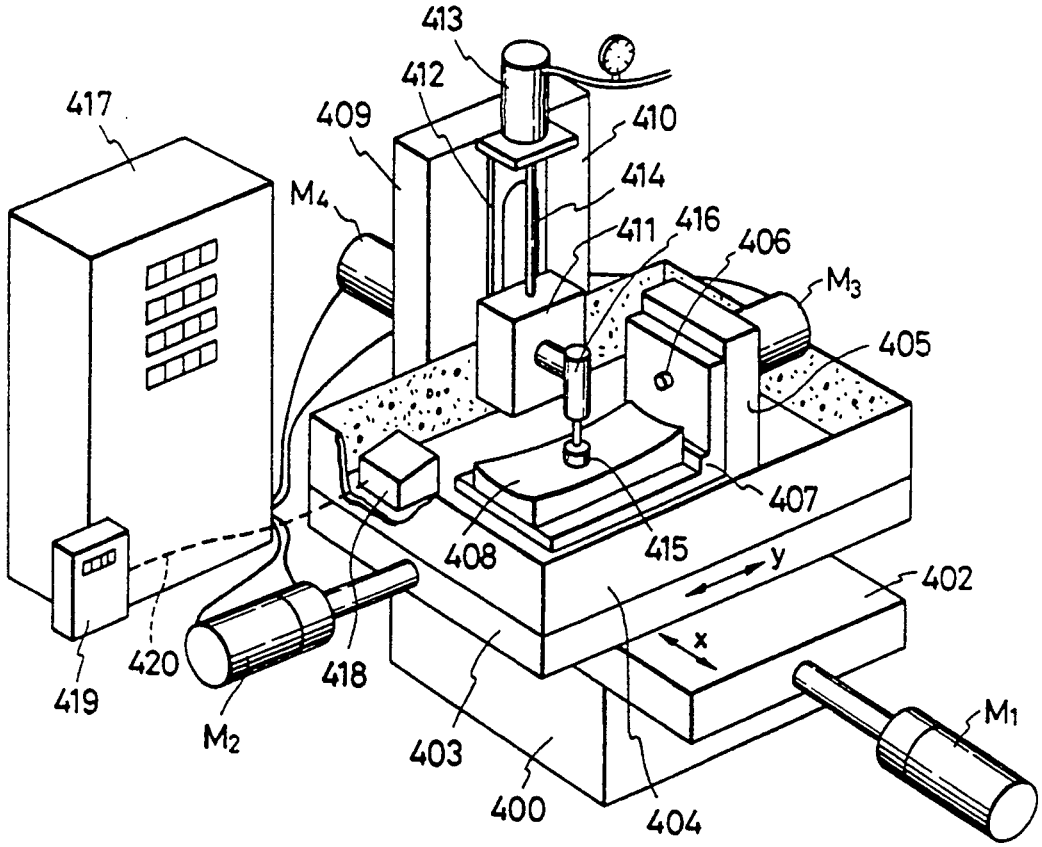

FIG. 19 shows an embodiment of the polishing apparatus for effecting the polishing process explained above, in which provided are an X-table 402 movable in the X-direction on a base plate 400; a Y-table 403 movable in the Y-direction on said X-table; and a liquid tank 404 fixed on said Y-table 403. The X- and Y-tables 402, 403 are respectively driven by motors M1, M2. On a vertical plate 405 vertically fixed on the bottom of said liquid tank 404, a work piece support plate 407 is supported in a rotatable manner about a rocking shaft 406. Said support plate 407 has an L-shape, of which a vertical portion is positioned parallel to the vertical plate 405 while a horizontal portion is separated from the bottom of the liquid tank 404 by a distance necessary for rocking motion. A work piece 408 is placed on said horizontal portion, and the support plate 407 is given a rocking motion by a motor M3.

A base pillar 409 extends vertically from the rear end of the base plate 400, and has a vertical face 411 on which a slide rail 412 is mounted for guiding a housing 411 along said vertical face 410. An air cylinder 413 is fixed at the upper end of the vertical face of the base pillar 409, and a piston rod 414 of said air cylinder 413 is connected, at the lower end, to the housing 411. A polishing tool 415 is supported by a holder 416 and is rendered rockable by a motor M4 and a bearing provided in said holder. A control unit 417 controls the motors M1, M2, M3 and M4.

The polishing process and apparatus of the present embodiment is featured by the formation, in the polishing liquid contained in the tank 404, of layers of polishing particles according to the specific gravity and size thereof, and, for this purpose, there is provided a high frequency oscillator 418 in the tank 404, and an oscillation control unit 4 19 positioned outside said tank and connected with said oscillator through a cable 420.

Excluding the high frequency oscillation means explained above , the liquid polishing apparatus shown in FIG. 19 is basically similar to the conventionally known apparatus and will not , therefore , explained in further detail.

Figure 20:
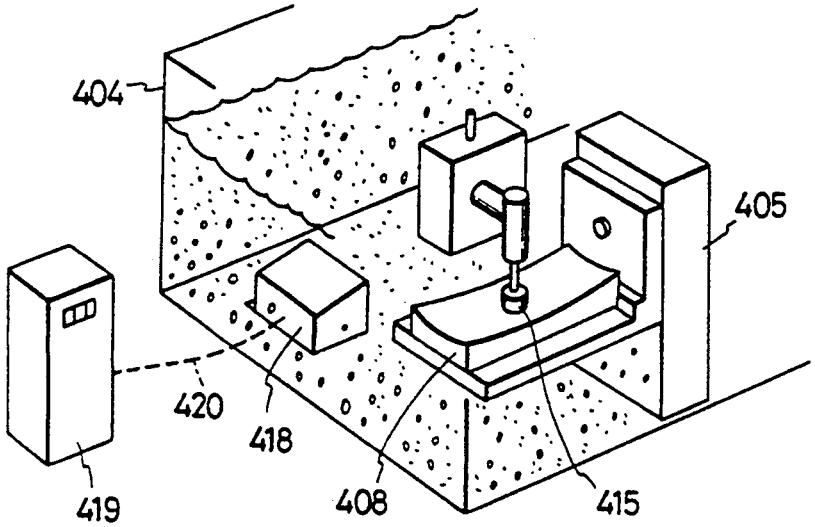

FIG. 20 is a partially cut-off perspective view showing the arrangement of the oscillation means for the polishing liquid of the present embodiment and the laminar distribution of the polishing particles obtained by the high frequency oscillation. The work piece 408 is supported in a rockable manner by the vertical plate 405, and the polishing tool 415 is placed on an appropriate position on the surface to be polished. The high frequency oscillator 418 and the oscillation control unit 419 are connected by the cable 420, and the particles of smaller size and those of larger size are respectively distributed in the upper portion and the lower portion of the polishing liquid, through the oscillation by said oscillator.

Figure 21:
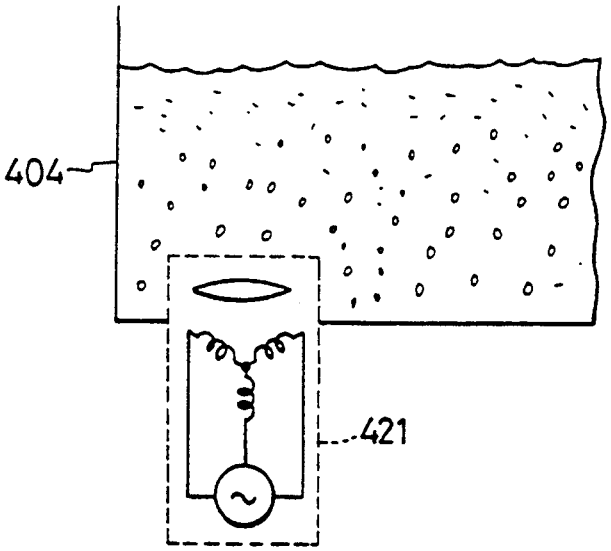
Figure 22:
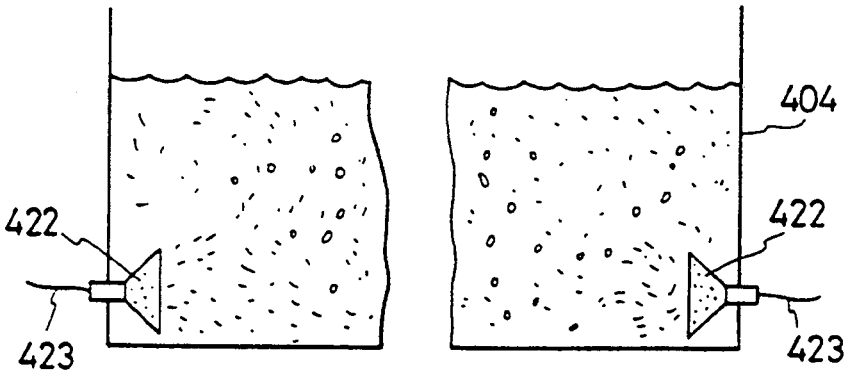
Figure 23:
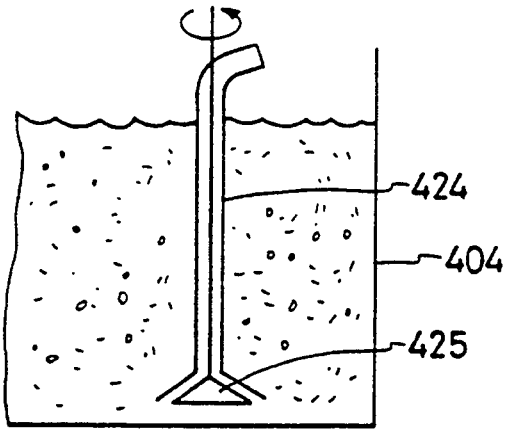

FIGS. 21, 22 and 23 show other embodiments for obtaining laminar distribution of the polishing particles, respectively employing a magnetic stirrer 421; an air nozzle 422 from an air supply pipe 423; and a combination of a polishing liquid supply pipe 424 and a rotary stirrer 425. Also other various known stirring means may be employed in combination.

As explained in the foregoing, the polishing process and apparatus of the present embodiment are featured in distributing the polishing particles of different specific gravities and sizes present in the polishing liquid into layers according to these properties, thereby supplying desired polishing particles to the polishing position, thus obtaining a satisfactory coarseness on the polished surface and achieving a high and stable working efficiency.

FIGS. 24 to 27 illustrate another embodiment for achieving the third object of the present invention.

Even if the polishing particles in the polishing liquid are classified in advance, the particles generally show a considerably wide distribution.

Consequently, even in case of polishing a spherical surface, the polishing particles of a desired particle size may not be supplied to the polishing position depending on the level of flow of the polishing liquid, so that there may result a lowered polishing efficiency or it may become impossible to achieve a satisfactory surface coarseness.

The present embodiment is to provide a polishing process by immersing a work piece in polishing liquid containing polishing particles of different particle sizes, in which said polishing liquid is stirred to form a desired distribution of particle size of the polishing particles therein and the polishing operation is conducted by supplying polishing particles of desired particle size to the polishing position.

Also the present embodiment is to provide a polishing apparatus adapted for executing the abovementioned process, comprising means for stirring polishing liquid in a polishing tank; means for measuring the particle size of polishing particles in an appropriate position in said polishing tank; and means for suitably setting the stirring conditions of said stirring means according to the result of measurement by said measuring means.

In the following the present embodiment will be explained in further detail.

Figure 24:
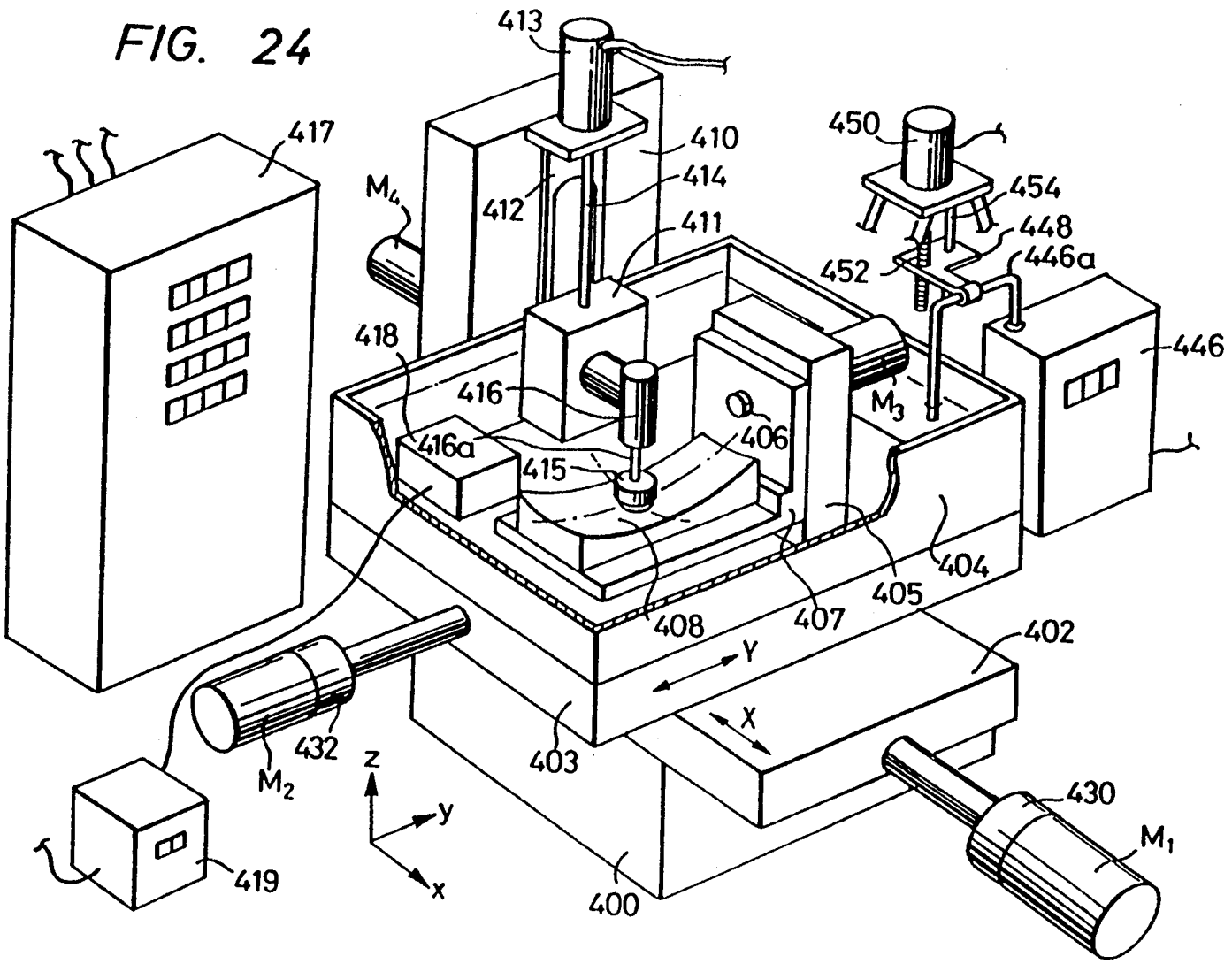

FIG. 24 is a schematic view of an apparatus for executing the polishing method explained above, in which same components as those in FIG. 19 are represented by same numbers.

In FIG. 24, a Y-table 402, capable of reciprocating in the Y-direction, is mounted on a base member 400. A motor M1 for driving said Y-table, is equipped with an encoder 430 for detecting the amount of movement of said Y-table in the Y-direction. On said Y-table there is mounted an X-table 403, capable of reciprocating in the X-direction with respect to said Y-table. A motor M2, for driving said X-table, is equipped with an encoder 432 for detecting the amount of movement of said X-table in the X-direction.

On said X-table there is fixed a polishing tank 404, in which fixed is a support member 405 for supporting a work piece 407 by means of a shaft 406. Said support member has an L-shape, of which the vertical portion is connected to said shaft 406. Said shaft 406 is positioned along the Y-direction, so that the support member 407 can rotate about the Y-direction. Said support member 405 is equipped with a motor M3 of which shaft is connected to the above-mentioned shaft 406.

A support member 410 is fixed on said X-table 403, outside said polishing tank 404 and is provided with a guide member 412 in the vertical Z-direction, on which a polishing tool support member 411 is mounted in vertically movable manner. Said support member supports a motor 416 so as to be rotatable about the X-direction, and a polishing tool 415 is fixed at the lower end of the rotary shaft **416*a* of said motor 416. Said support member 411 supports a motor M4 of which the is connected to said motor 416 for rotating the same around the X-direction. An air cylinder 413 is provided for vertically moving said support member 411 along the guide 412 and applying a predetermined pressure, and the rod 414 of said air cylinder is connected to the support member 411**.

Said polishing tank 404 contains polishing liquid, containing polishing particles of different particle sizes. In said polishing tank there is provided an ultrasonic oscillator 418, as liquid stirrer, dipped in the polishing liquid. 419 is a driver for said ultrasonic oscillator.

A unit 446 is provided for measuring the particle size of the polishing particles in the polishing liquid, and a liquid intake pipe **446*a* extends into the polishing liquid in the tank 404. Said intake pipe 446*a* is connected to a link member 448 connected in turn to elevating means consisting of a motor 450, a feed screw 452 connected to the shaft of said motor, and a guide member 454 positioned parallel to said feed screw, wherein said feed screw and said guide member engage with said link member 448. Thus, when the feed screw 452 is rotated by the motor 450, the link member 448 vertically moves along the guide member 454 thereby vertically moving the intake pipe 446*a***.

A control unit 417 receives the amounts of movement of the X- and Y-tables from the encoders 430, 432 and the result of measurement of said particle size measuring unit 446, and drives the motors M1, M2, M3, 416 and M4, the air cylinder 413, the ultrasonic oscillator driver 444, the particle size measuring unit 446 and the motor 450 of the elevating means.

In the polishing operation with the aboveexplained polishing apparatus, the work piece 408 is fixed on the support member 407. Said work piece is finished to predetermined shape and surface coarseness by a preliminary working, and is assumed, in the present embodiment, to have a concave toric surface to be polished.

Then the polishing tool 415 is placed on said work piece 408.

Figure 25:
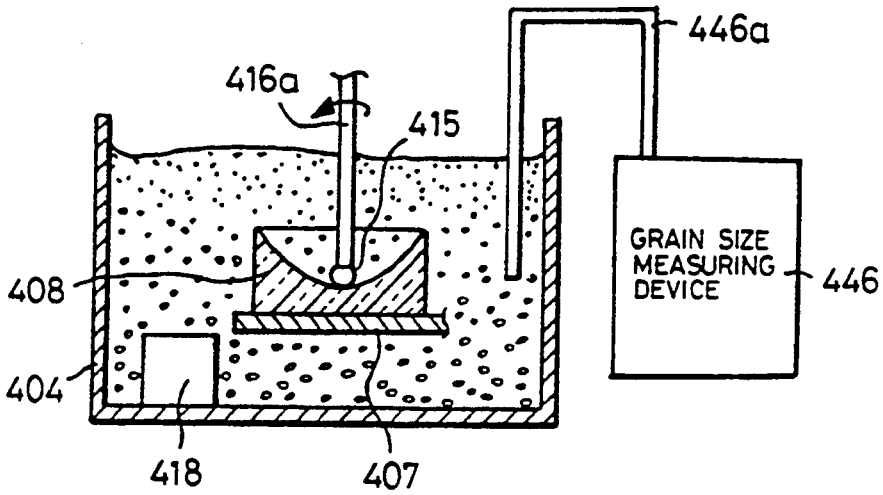
Figure 26:
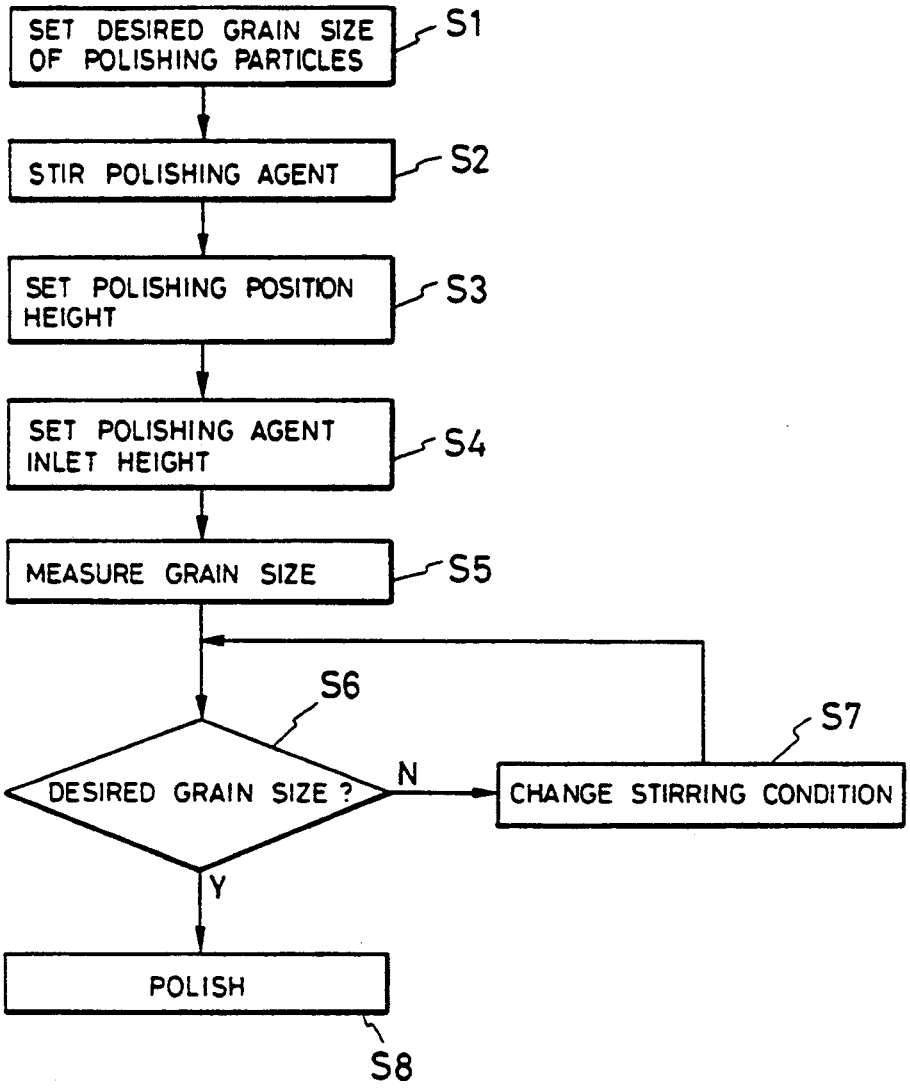

FIG. 25 is a schematic cross-sectional view of the polishing tank in the polishing operation, and FIG. 26 is a flow chart showing the function of the above-explained apparatus in the polishing operation.

At first a step S1 determines the particle size of the polishing particles to be used for polishing, among the different sizes present in the polishing liquid, and sets said desired particle size (which may have a certain range in practice). Said particle size is supplied to and stored in said control unit 417.

In a step S2, the control unit 417 sends a driving signal to said driver 444 for the ultrasonic oscillator, and, in response, the ultrasonic oscillator 42 starts oscillation with a suitable first amplitude for stirring the polishing liquid. As the result there is obtained a first laminar particle size distribution as shown in FIG. 25, in which relatively large particles are positioned in a higher portion and relatively small particles are positioned in a lower portion.

Then a step S3 selects the height of a portion to be polished of the polished surface of the work piece 8. This selection can be easily achieved in said control unit, based on the position to be polished, and the arrangement of the work piece 408 and the polishing tool 415 determined in advance for the polishing of said position and stored in the control unit 456.

Then, based on the height of polishing position obtained in the step S3, a step S4 adjusts the aperture of the polishing liquid intake pipe 446*a* at said height, by suitably driving the motor 450 of said elevating means by an instruction from the control unit 417.

In a next step S5, the control unit 4 17 activates said particle size measuring unit 446, whereby the polishing liquid at said height of the polishing position is inhaled from the intake pipe 446*a* and the particle size of the polishing particle in said liquid is measured. The result of said measurement is stored in the control unit 417.

In a next step S6, the control unit 4 17 discriminates whether the particle size obtained in said measurement is within the desired range of particle size memorized in the foregoing step S1.

If said step S6 identifies that the measured particle size is different from the desired particle size, a step S7 varies the stirring condition of the polishing liquid by the ultrasonic oscillator 442. More specifically, if the measured particle size is larger than the desired particle size, the control unit 417 sends an instruction to the driver 444 so as to drive the ultrasonic oscillator with a second amplitude smaller than the aforementioned first amplitude, thereby forming a second laminar distribution in which the particle size at the height of the polishing position is smaller than that in said first laminar distribution. On the other hand, if the measured particle size is smaller than the desired particle size, the control unit 417 sends an instruction to the driver 444 so as to drive the ultrasonic oscillator 442 with a third amplitude larger than said first amplitude, thereby forming a third laminar distribution in which the particle size at the height of the polishing position is larger than that in said first laminar distribution.

The above-explained sequence starting from the step S5 is executed after said step S7.

On the other hand, if the step S6 identifies that the measured particle size matches the desired particle size, a step S8 then starts the polishing operation of said polishing position.

In the polishing operation, the control unit 417 sends an instruction to activate the air cylinder 413, thereby pressing the polishing tool 415 to the work piece 408 at an appropriate pressure, by means of the support member 411 and the motor 416. Also another instruction from the control unit 417 activates the motor 416 to rotate the shaft 416*a* and the polishing tool 415.

After the polishing or a desired polishing position is completed in this manner, the above-explained procedure is repeated for a position to be polished next.

The movement of the polishing position on the surface to be polished is achieved in the following manner.

An instruction from the control unit 417 activates the motor M1 to move the Y-table 402 in the Y-direction. The position of the Y-table 402 is detected from the output of the encoder 430, and, in response to the change in the position in the Y-direction, the motor M4 is activated in a predetermined manner to rotate the motor 416 about the X-direction, whereby the polishing tool 415 is moved in the Y-direction on the surface to be polished, while it is pressed to said surface and the shaft 416*a* is maintained substantially perpendicular to said surface.

When the polishing in the Y-direction over a predetermined width is completed on the work piece 408 by the above-explained movement in the Y-direction, the control unit 417 activates the motor M2 to move the X-table 403 in the X-direction. The position of the X-table 403 is detected from the output of the encoder 432, and, in response to the change in the position in the X-direction, the motor M3 is activated in a predetermined manner to rotate the work piece support member 407 by a suitable angle about the Y-direction. Then the area of a predetermined width is polished with the movement of the Y-table and the rotation of the motor 416 about the X-direction in the same manner as explained above.

The entire work piece can be uniformly polished by the repeated movements of the polishing tool in the X- and Y-directions with respect to the work piece 408. The intermittent movement of the X-table 403 and the intermittent rotation of the support member 407 can be achieved by driving the motor M3 in a predetermined manner in response to the change in the position in the X-direction of the X-table, detected from the output of the encoder 432, whereby the work piece support member 407 is rotated about the Y-direction so that the polishing tool 415 is pressed to the work piece while the motor shaft 416*a* is maintained substantially perpendicular to the surface to be polished.

In the above-explained movement of the polishing position, it is also possible to divide the height of the polishing position into suitable zones and to conduct the polishing operation and the movement of the polishing position under a same stirring condition with a same zone.

Figure 27:
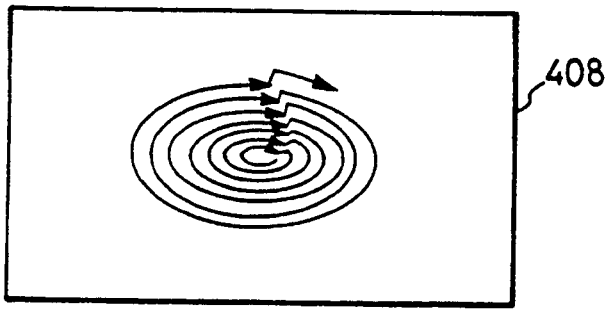

In the foregoing embodiment the movements in the X- and Y-directions are alternately conducted at the movement of the polishing position on the surface to be polished, but it is also possible to effect the polishing at each height in order to minimize the changes in the stirring condition. FIG. 27 shows the trajectory of movement of the polishing position on the surface to be polished in such case.

In the above-explained embodiment, it is rendered possible to effect the polishing operation with same polishing liquid, achieving efficient polishing in the beginning with relatively large polishing particles, then gradually reducing the surface coarseness and finally obtaining a satisfactory polished surface, by repeating the polishing of the entire surface several times, with the particle size in the step S1 shown in FIG. 26 set initially at a relatively large value and subsequently set at gradually reduced values.

Also the above-explained embodiment can achieve an polishing operation with optimum efficiency with same polishing liquid for various work pieces, by appropriately selecting the stirring condition according to the desired surface coarseness.

In the foregoing embodiment the polishing liquid stirring means is composed of an ultrasonic oscillator, but, in the present invention, it may be replaced by another means such as a magnetic stirrer utilizing magnetic driving force, means for stirring by omitting small bubbles into the polishing liquid, or means of emitting the polishing liquid into said polishing liquid.

Although the surface to be polished is a toric surface in the foregoing embodiment, the present invention is naturally applicable similarly to other rotationally asymmetric or symmetric aspherical surfaces, spherical surfaces and planar surfaces.

In the foregoing embodiment, the distribution of particle size of the polishing particles present in the polishing liquid can be suitably determined according to the desired surface coarseness, and may have a range from a small size for obtaining an optical surface to a size for obtaining a matted surface or even a so-called ground surface.

The foregoing embodiment, as explained above, is capable of stable and efficient polishing operation by supplying, in the polishing liquid, polishing particles of a desired size to the polishing position.

Also the foregoing embodiment is capable of stepwise polishing in which the surface coarseness is gradually reduced in the same polishing liquid.

Furthermore the foregoing embodiment has an advantage of polishing various work pieces in the same polishing liquid without the change thereof.

What is claimed is:

1. A method of working a workpiece with a polishing tool, comprising the steps of:

using a polishing tool having a polishing surface attached thereto;

providing the polishing tool with a closed loop electronic feedback system;

pressing the polishing tool onto a position of a surface of the workpiece to be polished using a pressing device;

detecting a pressing force acting in an axial direction of the polishing tool on the surface using a sensor mounted on the polishing tool and electronically connecting to the feedback system;

obtaining correction information by comparing a signal corresponding to the pressing force detected by the sensor and sent through the feedback system with a signal corresponding to a predetermined pressure; and adjusting the pressing force applied from the pressing device to the polishing tool on the basis of the correction information.

2. A method of working a workpiece with a polishing tool, the polishing tool being moved on a surface of the workpiece to be worked by moving means, comprising the steps of:

using a polishing tool having a polishing surface attached thereto;

providing the polishing tool with a closed loop electronic feedback system;

pressing the polishing tool onto a working position of the surface to be worked using pressing means;

detecting an actual pressing force of the polishing tool on the surface using a sensor mounted on the polishing tool and electronically connected to the feedback system;

obtaining deviation correction information indicating a deviation of the polishing tool from a predetermined working position by comparing a signal corresponding to the pressing force detected by the sensor and sent through the feedback system with a signal corresponding to a predetermined pressure; and controlling the moving means on the basis of the deviation correction information to adjust the working position of the polishing tool.

3. A method comprising the steps of:

abutting an end of an inclined polishing tool against a surface of a workpiece to be polished, with the end of the polishing tool which abuts the surface to be polished having a curved surface;

providing the polishing tool with a closed loop electronic feedback system;

applying pressure from pressure applying means onto the other end of the polishing tool;

detecting an amount of displacement of the polishing tool with respect to the surface of the workpiece with a detecting device directly attached to the polishing tool and electronically connecting to the feedback system;

inputting a detection signal form the detecting means and sent through the feedback system to a correction value calculating device and obtaining a correction value corresponding to the amount of displacement; and adjusting the pressure of the pressure applying mean son the basis of the correction value to polish the workpiece.

* * * * *

UNITED STATES PATENT AND TRADEMARK OFFICE

CERTIFICATE OF CORRECTION

PATENT NO. : 5,347,763

DATED : September 20, 1994

INVENTOR(S) : Miyamoto et al.

It is certified that error appears in the above-indentified patent and that said Letters Patent is hereby corrected as shown below:

On the title page, item [19] and item [75], "Miyamato" should read --Miyamoto--.

COLUMN 12:

Line 9, "operation," should read --operation.-- and "Consequently" should read --Consequently,--.

COLUMN 20:

Line 30, "the" should read --the shaft--.

COLUMN 21:

Line 15, "42" should read --442--.
Line 23, "8." should read --408.--.

UNITED STATES PATENT AND TRADEMARK OFFICE

CERTIFICATE OF CORRECTION

PATENT NO. : 5,347,763 Page 2 of 2

DATED : September 20, 1994

INVENTOR(S) : Miyamoto et al.

It is certified that error appears in the above-indentified patent and that said Letters Patent is hereby corrected as shown below:

COLUMN 24:

Line 52, "mean" should read --means--.
Line 53, "son" should read --on--.

Signed and Sealed this

Twenty-first Day of March, 1995

*Attest:*

Bruce Lehman

BRUCE LEHMAN

*Attesting Officer*

*Commissioner of Patents and Trademarks*